US009004832B1

(12) United States Patent
Crane et al.

(10) Patent No.: US 9,004,832 B1
(45) Date of Patent: Apr. 14, 2015

(54) INTERMODAL CONTAINER

(71) Applicant: Raildecks (2009) Inc., Calgary (CA)

(72) Inventors: Murray Crane, Calgary (CA); Rick Jocson, Calgary (CA)

(73) Assignee: Raildecks (2009), Inc., Calgary (CA)

( * ) Notice: Subject to any disclaimer, the term of this patent is extended or adjusted under 35 U.S.C. 154(b) by 0 days.

(21) Appl. No.: 13/892,908

(22) Filed: May 13, 2013

Related U.S. Application Data

(60) Provisional application No. 61/646,720, filed on May 14, 2012, provisional application No. 61/663,820, filed on Jun. 25, 2012.

(51) Int. Cl.
*B60P 7/08* (2006.01)
*B60P 3/00* (2006.01)
*B65D 19/00* (2006.01)

(52) U.S. Cl.
CPC ..... *B65D 19/0002* (2013.01)

(58) Field of Classification Search
CPC .... B62D 25/2054; B62D 21/20; B62D 53/06; B62D 53/067; B62D 65/00; B60P 7/0815; B60P 7/135; B60P 7/13; B60P 7/132; B60P 1/6418; B60P 3/073; B60P 3/08; B60P 3/41; B60P 7/12; B23K 2201/28; B23K 37/04; B65G 2201/0294
USPC ..... 410/46, 77, 31, 34–35, 43, 56–57, 66, 410/71, 76, 78, 104, 2, 100; 414/227; 220/1.5, 6–8, 23.4, 23.6
See application file for complete search history.

(56) References Cited

U.S. PATENT DOCUMENTS 2,170,185 A 8/1939 Scott
2,413,404 A * 12/1946 Black ..... 206/577
(Continued)

FOREIGN PATENT DOCUMENTS

CA 2689737 4/2010
CA 2681296 3/2011
(Continued)

OTHER PUBLICATIONS

Clive-Smith Associates Ltd, Domino Collapsible Flatrack, 48 ft Domino Type (13) lightweight intermodal, Part #SB47138, Ref 48(13) Mar. 1 SB, 1 page.
(Continued)

*Primary Examiner* — Glenn Dayoan
*Assistant Examiner* — Sunsurraye Westbrook
(74) *Attorney, Agent, or Firm* — Neal, Gerber & Eisenberg LLP

(57) ABSTRACT

An extendable, intermodal transport platform is disclosed. The invention comprises a standard ISO-length loading platform supported by main beams and crossmembers. The platform has ISO lifting and stacking fitments at its four corners. The platform has extendable supplemental platforms at each end, the extendable supplemental platforms fitting beneath the deck bed of the platform, or extendable to position stacking fitments at over-the-road trailer positions for North American fleet. Inner stacking fitments may laterally expand and retract so as to slide underneath the deck bed between the main beams. In some embodiments the platform includes posts that extend upward to position ISO lifting fitments at standard heights, such as under hydraulic power.

20 Claims, 31 Drawing Sheets

(56) References Cited

U.S. PATENT DOCUMENTS

| | | | | |
|---|---|---|---|---|
| 2,461,577 | A * | 2/1949 | Stark, Jr. | 296/26.02 |
| 3,048,437 | A * | 8/1962 | Linder | 410/4 |
| 3,073,466 | A | 1/1963 | Greer et al. | |
| 3,085,707 | A | 4/1963 | Tatlinger | |
| 3,195,506 | A | 7/1965 | Beard | |
| 3,480,174 | A | 11/1969 | Sherwood | |
| 3,591,033 | A | 7/1971 | Partridge | |
| 3,612,569 | A | 10/1971 | Marinelli | |
| 3,735,713 | A | 5/1973 | Glassmeyer | |
| 3,995,760 | A | 12/1976 | Burgdorf | |
| 4,068,813 | A | 1/1978 | Chatwin et al. | |
| 4,099,640 | A | 7/1978 | Nessfield et al. | |
| 4,162,737 | A | 7/1979 | Clive-Smith | |
| 4,353,520 | A | 10/1982 | Jansson | |
| 4,586,646 | A | 5/1986 | Booher et al. | |
| 4,591,307 | A | 5/1986 | Clive-Smith | |
| 4,646,928 | A | 3/1987 | Ono et al. | |
| 4,650,381 | A | 3/1987 | Durkin | |
| 4,653,659 | A | 3/1987 | Bersani | |
| 4,848,618 | A | 7/1989 | Yuan et al. | |
| 4,917,557 | A | 4/1990 | Kato et al. | |
| 5,257,896 | A | 11/1993 | Hastings | |
| 5,275,301 | A | 1/1994 | Clive-Smith | |
| 5,494,182 | A | 2/1996 | Clive-Smith | |
| 5,509,559 | A | 4/1996 | Okano | |
| 5,639,174 | A | 6/1997 | Gonska | |
| 5,644,992 | A | 7/1997 | Clive-Smith | |
| 5,810,186 | A | 9/1998 | Lam | |
| 5,941,405 | A | 8/1999 | Scales et al. | |
| 6,123,208 | A | 9/2000 | Haenszel | |
| 6,227,397 | B1 | 5/2001 | Kim | |
| 6,241,438 | B1 * | 6/2001 | Corbett et al. | 410/56 |
| 6,317,981 | B1 | 11/2001 | Clive-Smith | |
| 6,513,442 | B1 | 2/2003 | Miller et al. | |
| 6,655,300 | B1 | 12/2003 | Clive-Smith | |
| 6,739,468 | B1 | 5/2004 | Colebrook | |
| 6,866,160 | B2 | 3/2005 | Wang et al. | |
| 7,011,223 | B1 | 3/2006 | Grigsby, Sr. | |
| 7,011,479 | B2 | 3/2006 | Sain | |
| 7,131,803 | B2 | 11/2006 | Guarisco, Sr. et al. | |
| 7,270,508 | B2 * | 9/2007 | Nichols | 410/56 |
| 7,568,754 | B2 | 8/2009 | Adams | |
| 7,571,953 | B2 | 8/2009 | Adams | |
| 7,739,965 | B2 | 6/2010 | Heinrichs et al. | |
| 7,802,526 | B2 | 9/2010 | Brady et al. | |
| 7,823,739 | B2 | 11/2010 | Sadkin | |
| 7,874,773 | B2 * | 1/2011 | Awad | 410/32 |
| 7,896,427 | B2 | 3/2011 | Adams | |
| 8,057,143 | B2 | 11/2011 | Adams | |
| 8,262,328 | B2 | 9/2012 | Crane | |
| 8,342,784 | B2 | 1/2013 | Crane et al. | |
| 8,353,647 | B2 | 1/2013 | Crane et al. | |
| 8,608,415 | B2 | 12/2013 | Crane et al. | |
| 2002/0009345 | A1 | 1/2002 | Clive-Smith | |
| 2005/0000834 | A1 | 1/2005 | Clive-Smith | |
| 2005/0081762 | A1 | 4/2005 | Clive-Smith | |
| 2005/0180833 | A1 | 8/2005 | Almind | |
| 2006/0022426 | A1 | 2/2006 | Clive-Smith | |
| 2006/0104755 | A1 | 5/2006 | Clive-Smith | |
| 2007/0206999 | A1 | 9/2007 | Clive-Smith | |
| 2009/0273203 | A1 | 11/2009 | Adams | |
| 2011/0073595 | A1 | 3/2011 | Crane | |
| 2012/0076607 | A1 | 3/2012 | Crane et al. | |

FOREIGN PATENT DOCUMENTS

| | | | |
|---|---|---|---|
| CA | 2682416 | | 4/2011 |
| CN | 1240753 | | 1/2000 |
| EP | 0893366 | A2 | 1/1999 |
| GB | 2097364 | A | 11/1982 |
| GB | 2376014 | | 12/2002 |
| WO | 2006/005920 | A1 | 1/2006 |
| WO | 2007071942 | | 6/2007 |
| WO | 2009106521 | | 9/2009 |
| WO | 2011038480 | | 4/2011 |

OTHER PUBLICATIONS

PCT Search Report and Written Opinion for PCT/CA2010/00076 mailed Jun. 16, 2010.

PCT Search Report and Written Opinion for PCT/IB/002915, mailed Jun. 5, 2012.

Freight containers—Coding, identification and marking; International Standard; ISO 6346, Third Edition, Dec. 1, 1995; 1995(E).

ISO 6346 Container Codes: Datasheet (online]. ISO 6346 Container Codes, Check Digit, Calculator, Size & Type, 2012 (retrieved on Aug. 15, 2012]. Retrieved from the intemet: <URl : http:/www.shippingcontainers24.com/general/iso-6346-codes/#axzz23dHvOwl0.

45 Foot Shipping Container. Datasheet (online]. 45 foot Shipping Container Dimensions—45 Feet, Internal Sizes, Homes, 2012 (retrieved on Aug. 14, 2012]. Retrieved from the internet: <URL : http:/www.shippingcontainers24.com/dimensions/45-foot#axzz23dHvOwl0.

* cited by examiner

INTERMODAL CONTAINER

TECHNICAL FIELD

This application is a non-provisional of and claims priority to U.S. Patent Application Ser. No. 61/646,720 filed May 14, 2012 and U.S. Patent Application Ser. No. 61/663,820 filed Jun. 25, 2012, both incorporated herein by reference. The present invention relates to equipment for transporting cargo, and methods for operating such equipment. More specifically, the invention is directed at improved intermodal containers or transport platforms used for transporting cargo across multiple modes, such as rail or over-the-road hauling.

BACKGROUND OF THE INVENTION

Bulk cargo may be transported over long distances using various modes, such as ship, truck or railcar. Typically, the cargo is transported in rectangular, box-like containers that may be permanently connected to a wheeled chassis (such as in the case of a truck trailer or railcar), or may be independent containers that can be temporarily fixed to and transported on a railcar or truck chassis. The independent containers, referred to as intermodal containers, allow for a single load to be transported by multiple modes, e.g., truck and rail, without moving the cargo from one container to another. Rather, the entire container is lifted off of one chassis and on to another for further transport. These intermodal containers are also used to transport cargo by ship, where several containers are often stacked on top of each other.

Over time, standards have developed to help ensure that intermodal containers are compatible with the various modes of shipment. For instance, the length and width of intermodal containers must comport with the railcar or trailer chassis on which they will be hauled, attachment points must be properly positioned for mating, and the container height must allow for passage under overpasses or through tunnels while in transit. In addition, it is desirable that intermodal containers be of standard exterior dimensions so as to conserve space and provide load stability when positioning and stacking the containers on ship decks or in storage yards. The internationally standard size for an intermodal container is a rectangular box forty feet in length (~12 meters) and eight feet in width and height. Structural lift and stack points are located at each of its eight corners. These points, referred to at times herein as the forty foot points, correspond to the internationally standard gap between hooks on overhead cranes used at docks, rail yards and truck yards to load and unload the containers. Most containers used for overseas shipment are of this dimension. Though the forty foot containers may also be hauled via truck and rail, containers used exclusively for over-the-road and rail shipment are often longer (53 feet in North America; 45 feet in Europe) to utilize the extra length available on truck and rail chassis. For example, 53 feet is the standard over-the-road trailer length in North America. Though longer, these containers still provide structural fitments for lifting and stacking at the forty foot points. They also provide a second set of stack points, or "fitments," at the corners (i.e., beyond the forty foot points).

Intermodal standardization has lead to efficiencies in the logistics industry. For example, certain high-speed rail lines are dedicated to transporting dual-stacked intermodal containers because of the amount of cargo they can contain in a stacked configuration. While it may take cargo in a rail boxcar two weeks to travel from Chicago to Los Angeles, the same cargo loaded on intermodal cars may be there in a two days.

The inevitable need to relocate empty box-shaped intermodal containers is not efficient because the containers take up as much space empty as they do full. Even when empty, each container usually requires its own trailer chassis for highway transport, because just two standard containers stacked together would be too high for truck transport. At most, rail well cars can only move two standard intermodal containers at once, regardless of whether they are full or empty. Thus, it costs nearly as much to haul an empty container as a full one, but without the revenue from the transport of cargo to offset the cost. Even if container relocation is unnecessary, the empty containers still present a disadvantage in that they take up just as much space when stored in a yard as do full containers. In addition, conventional intermodal containers must be loaded and unloaded one pallet at a time by a forklift that enters and exits through one end of the container. Not only is this a slow process that presents spatial constraints to the forklift operator, it does not allow for the loading of lengthy materials such as pre-formed pipe, lumber, steel coils or other materials not suitable for palletizing.

Flatbed trailers and railcars solve some of these problems because a flatbed can be efficiently loaded from any direction, and can accommodate loading of items as lengthy as the flatbed itself. Flatbeds can also be efficiently stacked when not in use. However, flatbeds are not used for intermodal transport because they cannot be stacked when loaded, and they do not provide the requisite structural fitments at the forty foot points for lifting by an overhead crane. Rather, traditional flatbeds are permanently affixed to a trailer or railcar chassis, requiring that cargo transported by flatbed be moved from one flatbed to another in order to continue transport via another mode.

A solution to this problem is to enhance the traditional flatbed design by providing it with structural members at the appropriate lift positions, but allowing those members to collapse or be removed when the flatbed is to be stored or relocated. Though such designs have been attempted, they have not been adopted due to issues with safety, durability and functionality. The necessity of structural fitments at the forty foot points conflicts with the desire to enable side and/or top loading of large materials. Thus, there is a desire to move the structural members out of the way to allow for full-length, full-width loading, but then back into place prior to transport. Prior art collapsible intermodal designs have been functionally limited to forty-five feet of usable deck length.

Finally, prior art attempts at intermodal flatbeds have been limited in the amount of load they can support during lifting operations. By removing the side walls and top of a traditional intermodal container, the tensile load during lifting is fully concentrated at the points along the flatbed where the structural members connect. This point loading can lead to deformation of the flatbed if it is not sufficiently strong. Though the flatbed can be made stronger by adding more steel, this adds weight to the empty load. A heavier empty weight results in less cargo carrying capacity because government weight restrictions on total weight will be reached with less cargo. Despite these issues and challenges experienced in connection with prior art attempts to provide a collapsible intermodal solution, there remains a long felt need for a suitable intermodal transport platform for the logistics industry.

SUMMARY OF THE INVENTION

The present invention comprises a transport platform or container for intermodal transport that may be placed into a configuration to allow for top or even side loading, and generally may be collapsed in some manner to allow for more efficient empty transport or storage. The invention relates, in certain respects, to that disclosed in co-pending U.S. patent application Ser. No. 13/044,406 (the '406 Application), the contents of which are incorporated herein by reference in their entirety.

In a first embodiment, a full length loading platform is supported by a chassis comprised of multiple beams and crossmembers. The platform has ISO lifting and stacking fitments at its four corners, and also at the forty foot points. Outboard posts are connected via a rotatable axle at first ends. The second ends of the outboard posts are connected to inboard posts at a main joint. Extensions posts are also joined at the main joint, and extend upward in a first position to present an additional ISO lifting/stacking fitment at the forty foot point. This embodiment may support a loading position wherein the extension posts rotate outward and a storage position where the extension posts rotate inward toward the center of the platform and travel along the platform with the inboard posts until flat. A cable system may be employed to assist with the manipulation of the extension posts.

In a second embodiment, a full length loading platform is supported by a chassis comprised of multiple beams and crossmembers. The platform has ISO lifting and stacking fitments at its four corners. On each side of the platform are two foldable posts connected by a longitudinal stiffener at their upper ends. Each post is comprised of an upper section and a lower section. The upper sections and the stiffener move as an assembly and fold down against the lower sections. The lower section may then fold inward to the platform for a storage position, or outward and downward to hang off of the platform for loading when the platform is positioned on a truck or rail chassis.

In a third embodiment, a forty-foot loading platform is supported by a chassis comprised of multiple beams and crossmembers. The platform has ISO lifting and stacking fitments at its four corners. The platform has extendable ends that may extend from the ends of the loading platform to lengthen it for full length loading. Main posts are fixedly positioned at the forty foot points, and present ISO lifting/stacking fitments at their base. The main posts have multiple concentric segments that are extended telescopically upward, such as under hydraulic pressure. Once fully extended and secured, the upper end of each main post positions a second ISO lifting/stacking fitment at a proper height to convey intermodal cargo. When the main posts are fully lowered, the platforms may be stacked in a storage configuration. Support braces may be manually raised and pinned to the main posts to provide additional stability. The upper crossmember may be removed or not installed to allow for full length top loading.

In a fourth embodiment, a full length loading platform is supported by a chassis comprised of multiple beams and crossmembers. The platform has ISO lifting and stacking fitments at its four corners, as well as at its forty-foot points. In a first position, main posts extend from either side of the platform, and are connected with a crossbeam at their upper ends. The assembly formed by the posts and crossbeam is free to translate along the loading platform toward its ends so as to allow for full length loading. Once fully extended, the assembly can be lowered to the surface of the platform and secured for storage or empty hauling with other similar platforms stacked on top. A hydraulic system may be used to assist with translating the posts along the platform.

A better understanding of the objects, advantages, features, properties and relationships of the invention will be obtained from the following detailed description and accompanying drawings which set forth one or more illustrative embodiments which are indicative of the various ways in which the principles of the invention may be employed.

BRIEF DESCRIPTION OF THE DRAWINGS

The components in the following drawings are not necessarily to scale, emphasis instead being placed upon clearly illustrating the principles of the present invention. In the drawings, like reference numerals designate corresponding parts throughout the several views.

FIG. 28 is a side view of two of the collapsible intermodal containers of

FIGS. 25A-25C in the storage position stacked together.

DETAILED DESCRIPTION

Figure 1:
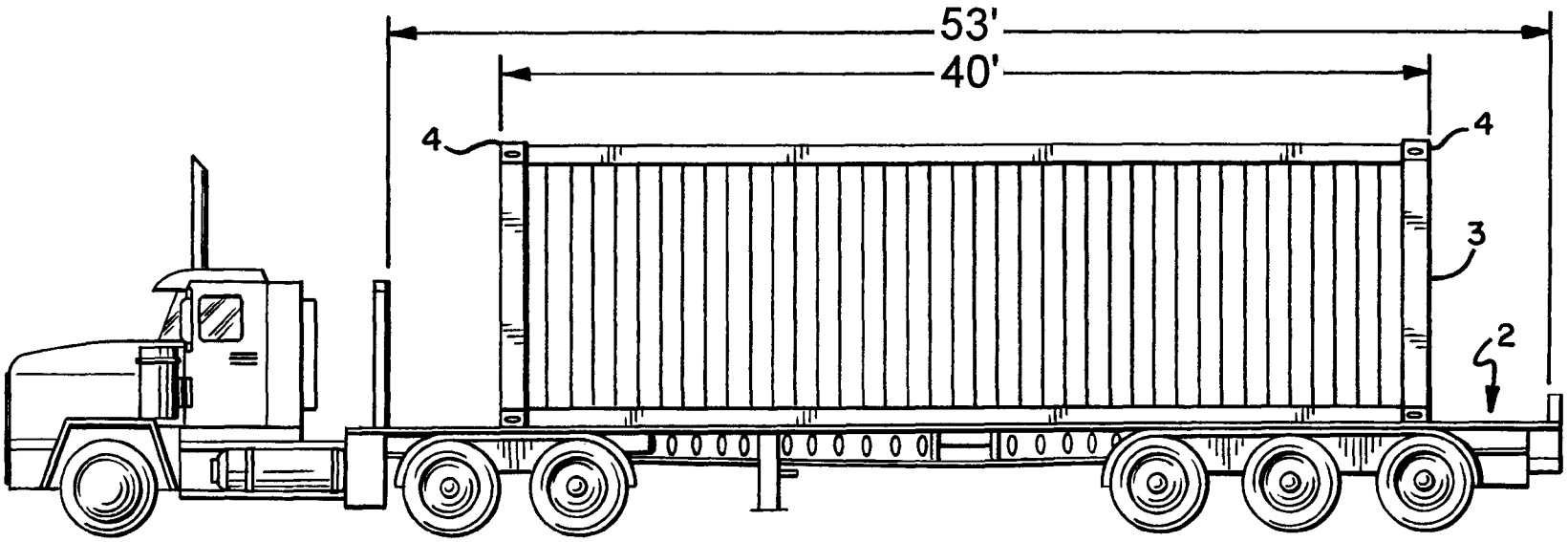
FIG. 1 PRIOR ART
FIG. 1 is a side view of a conventional 40-foot intermodal container loaded on a standard 53-foot truck chassis.

The description that follows describes, illustrates and exemplifies one or more particular embodiments of the present invention in accordance with its principles. This description is not provided to limit the invention to the embodiments described herein, but rather to explain and teach the principles of the invention in such a way to enable one of ordinary skill in the art to understand these principles and, with that understanding, be able to apply them to practice not only the embodiments described herein, but also other embodiments that may come to mind in accordance with these principles. The scope of the present invention is intended to cover all such embodiments that may fall within the scope of the appended claims, either literally or under the doctrine of equivalents.

It should be noted that in the description and drawings, like or substantially similar elements may be labeled with the same reference numerals. However, sometimes these elements may be labeled with differing numbers, such as, for example, in cases where such labeling facilitates a more clear description. Additionally, the drawings set forth herein are not necessarily drawn to scale, and in some instances proportions may have been exaggerated to more clearly depict certain features. Such labeling and drawing practices do not necessarily implicate an underlying substantive purpose. As stated above, the present specification is intended to be taken as a whole and interpreted in accordance with the principles of the present invention as taught herein and understood to one of ordinary skill in the art.

Figure 5:
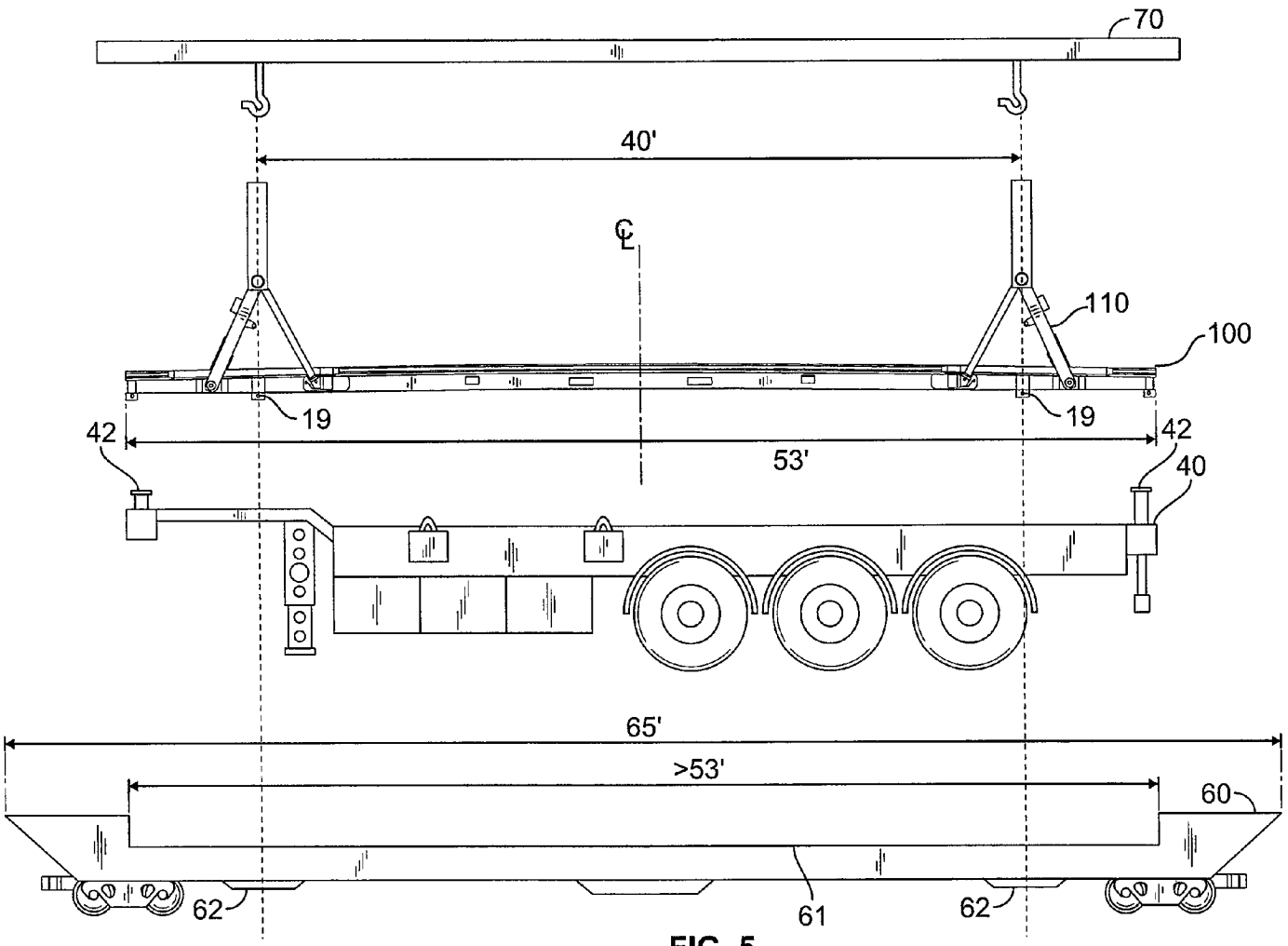
FIG. 5 is a side view of a collapsible intermodal container according to a particular embodiment overlaid with a rail well car, a trailer chassis and an overhead crane to illustrate the alignment of the forty foot points.

It will be understood throughout this application that the term "longitudinal centerline" will mean an imaginary line marking the midway point through the length of an object. For example, if a rectangle (or a rectangular loading surface) has a length of 40 feet and a width of 8 feet, its longitudinal centerline would be an imaginary line passing through the center of the rectangle, 20 feet from either end. For more clarity, the longitudinal centerline of the transport platform 10 shown in FIG. 5 has been superimposed in a side view, thus, distinguishing a right side from a left side. Though several embodiments are disclosed, this longitudinal centerline will always be in the same position, equidistant from the forty foot points. Distances from this longitudinal centerline would be measured perpendicular from the line to the left or right as shown in FIG. 5.

FIG. 1 shows a standard intermodal container 3 loaded onto a trailer chassis 2. Note that the trailer chassis 2 is longer than the standard intermodal container 3, with the typical trailer lengths being fifty-three feet in North America and forty-eight feet in Europe. However, the intermodal container 3 is only forty feet in length so as to position lift points 4 at the ISO standard forty foot points for lifting and stacking Intermodal container 3 is also limited in that it must be loaded through a door at one end, and it takes up considerable space even when empty.

Figure 2:
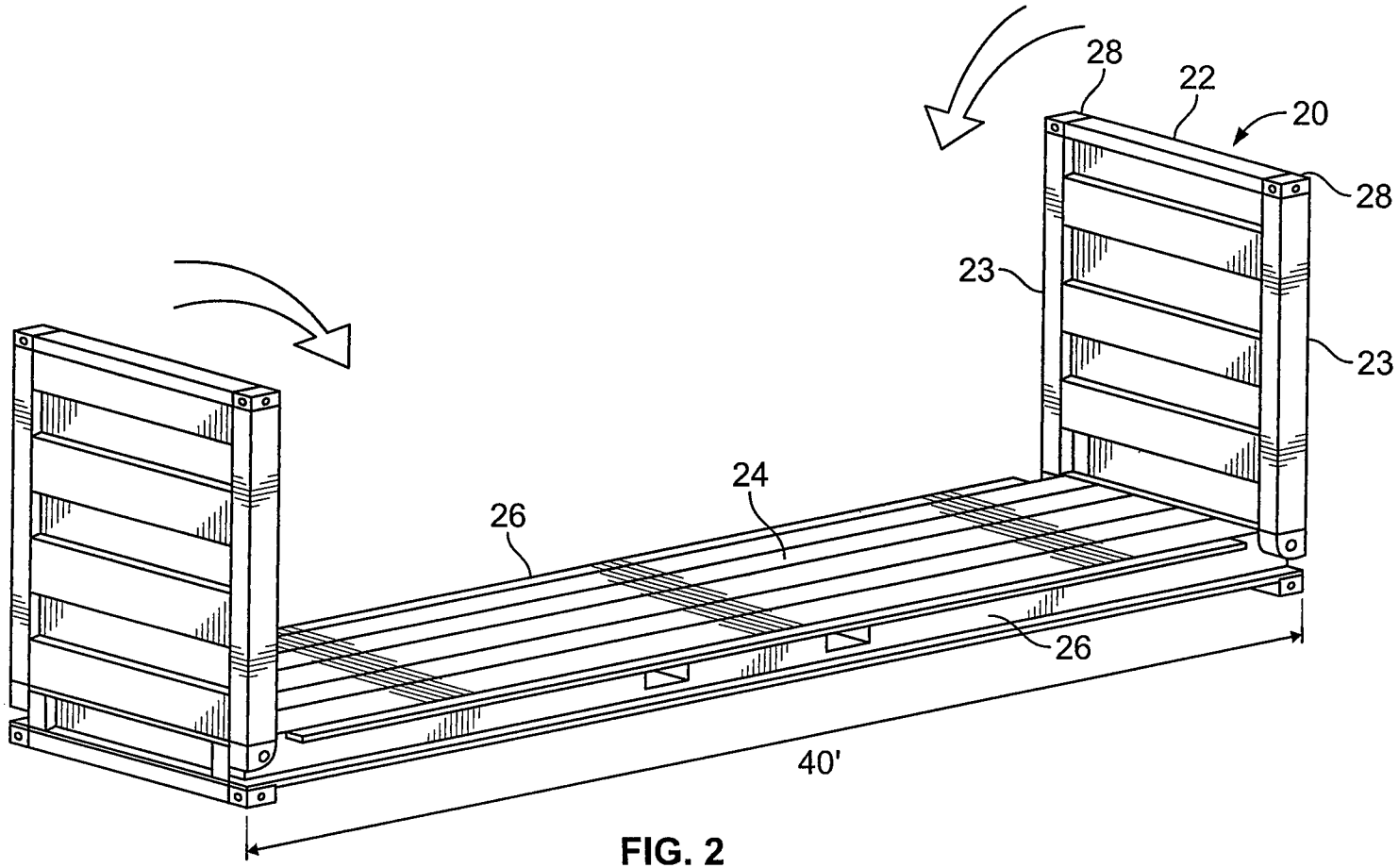
FIG. 2 (Prior Art)
FIG. 2 is a perspective view of a 40-foot flatbed with collapsible end walls.

The platform 20 of FIG. 2 solves some of these problems in that it may be top loaded or side loaded, and has collapsing end walls 22 that may be folded down onto the deck bed 24. The platform 20 has opposing deck beams 26, which are I-beams, each having two flat flanges connected by a vertical web. The deck beams 26 are connected by crossmembers (not shown) over which the decking of deck bed 24 is positioned. At the sides of each end wall 22 is a support post 23 that positions a fitment 28 at the Forty Foot Points to allow for lifting. As will be further understood after a description of the present invention's deck beams, this platform 20 could not support a heavy load while being lifted because deformation of the deck beams 26 would result. Moreover, though the end walls 22 rotate about their connection points to the deck beams 26 and collapse to the deck bed 24, converting the platform 20 in this manner is a rough, dangerous job requiring human operators to physically drop the end walls into place and manipulate them back into haul position. Finally, transport platform 20 presents a major limitation in that it cannot transport loads exceeding forty feet in length.

Figure 3:
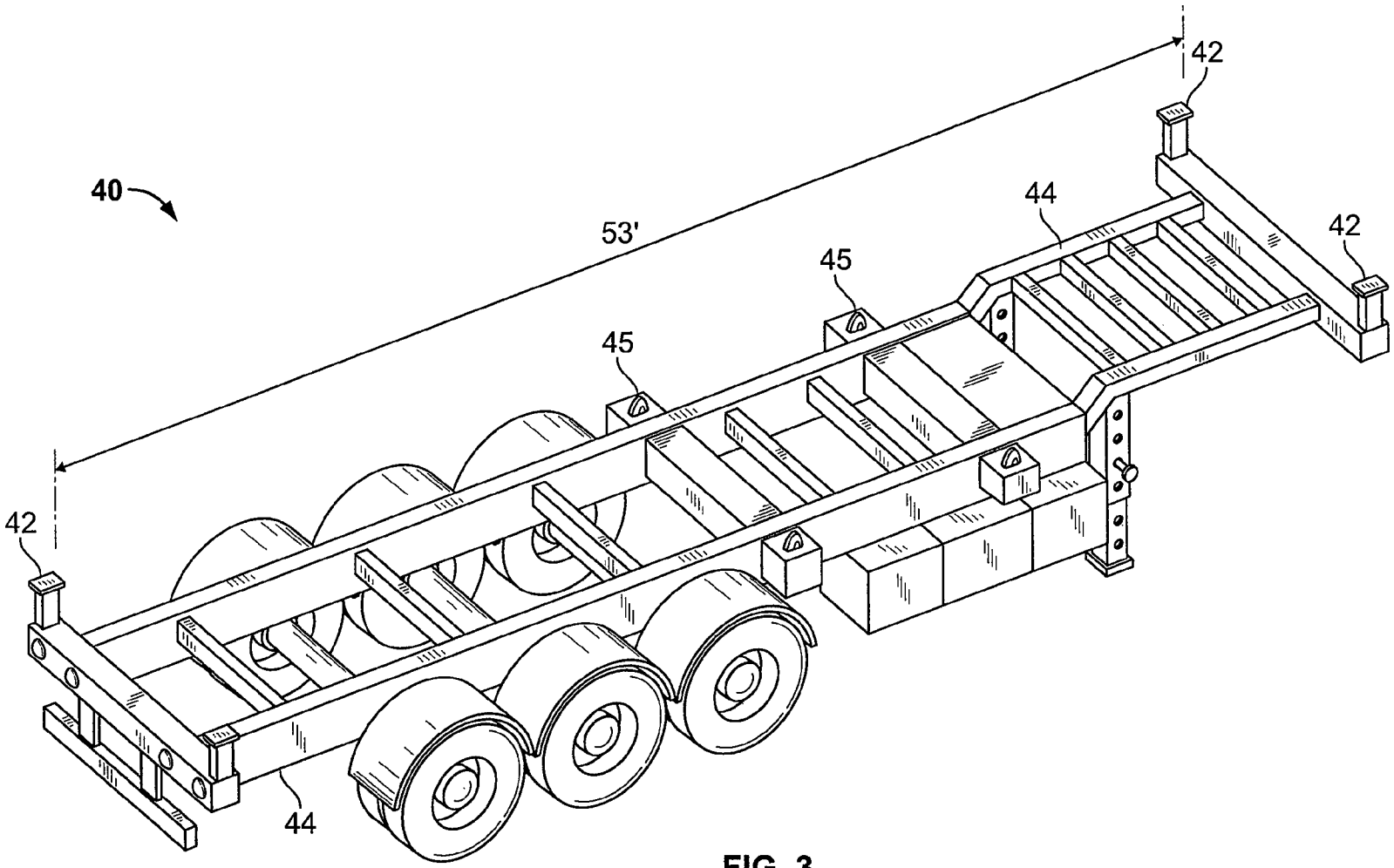
FIG. 3 is a perspective view of a standard unloaded over-the-road trailer chassis.
Figure 4:
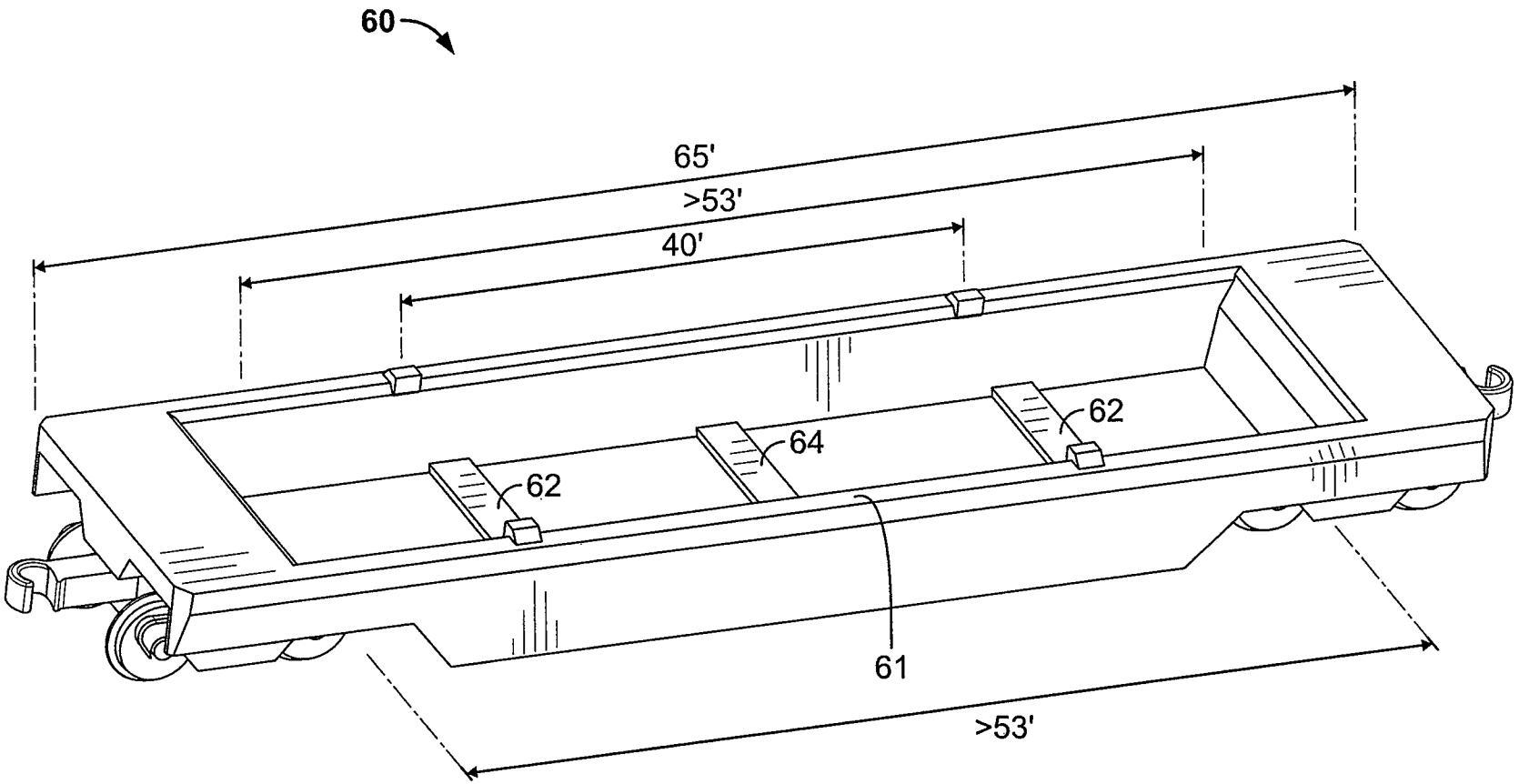
FIG. 4 is a perspective view of a standard well car used to transport intermodal containers by rail.

FIGS. 3 and 4 show existing chassis structures which help to demonstrate the intermodal nature and utility of the present invention. FIG. 3 displays a standard 53-foot trailer chassis 40. This type of trailer chassis may be used to support a flatbed up to fifty three feet in length. Corner fitments 42 are positioned to accept and secure such a flatbed, which has female receptacles designed to receive the fitments at the 53-foot positions. The trailer chassis may also be used to haul intermodal containers of varying lengths, depending on the placement of interior fitments 45. Each intermodal container also has female receptacles at its four corners—two for fitting over the rear corner fitments 42 and two for fitting over two of the interior fitments 45. The weight of the flatbed or intermodal container may also be supported by the chassis rails 44 that run the length of the trailer chassis. Though the width may vary, these rails 44 are approximately thirty-nine inches apart on a standard trailer chassis.

FIG. 4 displays a standard railroad well car 60, which is sixty-five feet in length. The well car features a well 61 which is used to house a standard intermodal container such as container 3 of FIG. 1. The well itself is designed to accommodate a 53-foot long container. At the bottom of the well 61 are primary crossmembers 62 and auxiliary crossmember 64. The primary crossmembers 62 are positioned so as to correspond with the forty foot points. The bottom of the well 61 may provide a solid floor or may be open to the tracks below, but standard well cars 61 will always provide support members such as primary crossmembers 62 at the forty foot points to align with corresponding fitments on intermodal containers. Accordingly, a flatbed or intermodal container having fitments or support structure at its base located twenty feet from its longitudinal centerline (for rail) and twenty-six and a half feet from its longitudinal centerline (for trailers) can be transported on a standard chassis in either mode of transport.

FIG. 5 provides a hypothetical overlay, using side views of the collapsible intermodal container 10, an overhead crane 70, a standard trailer chassis 40, and a railroad well car 60 to show how the container 100 vertically aligns with the devices used to lift, load or haul it. Though the container 100 shown differs in some respects from other embodiments set forth herein, it will be understood that the embodiments disclosed herein are all of the same standard length (when extended, where applicable), and position the ISO lifting and stacking fitments in the same locations. Accordingly, any of the intermodal container embodiments disclosed herein could be substituted for container 100 in FIG. 5 and would still line up with the key points on trailer 40 or rail well car 60.

The dotted lines through the forty foot points marked "A" show how these points are aligned with the lifting hooks on a standard overhead crane 70, as well as the primary crossmembers 62 of a standard railroad well car 60. The dotted line also shows how the lifting fitments 12 are positioned directly over the stacking block receivers 19 on the platform 100. Finally, though no line is provided, it is clearly evident how corner fitments 6 of the platform 100 are directly over the adjoining (albeit oversized, as illustrated) corner fitments 42 of the 53-foot trailer chassis 40. Were the platform 100 to be placed, instead, into the well 61 of the railroad well car 60, it would fit between the sides of the well, which are shown as able to accommodate the 53-foot container.

Figure 6:
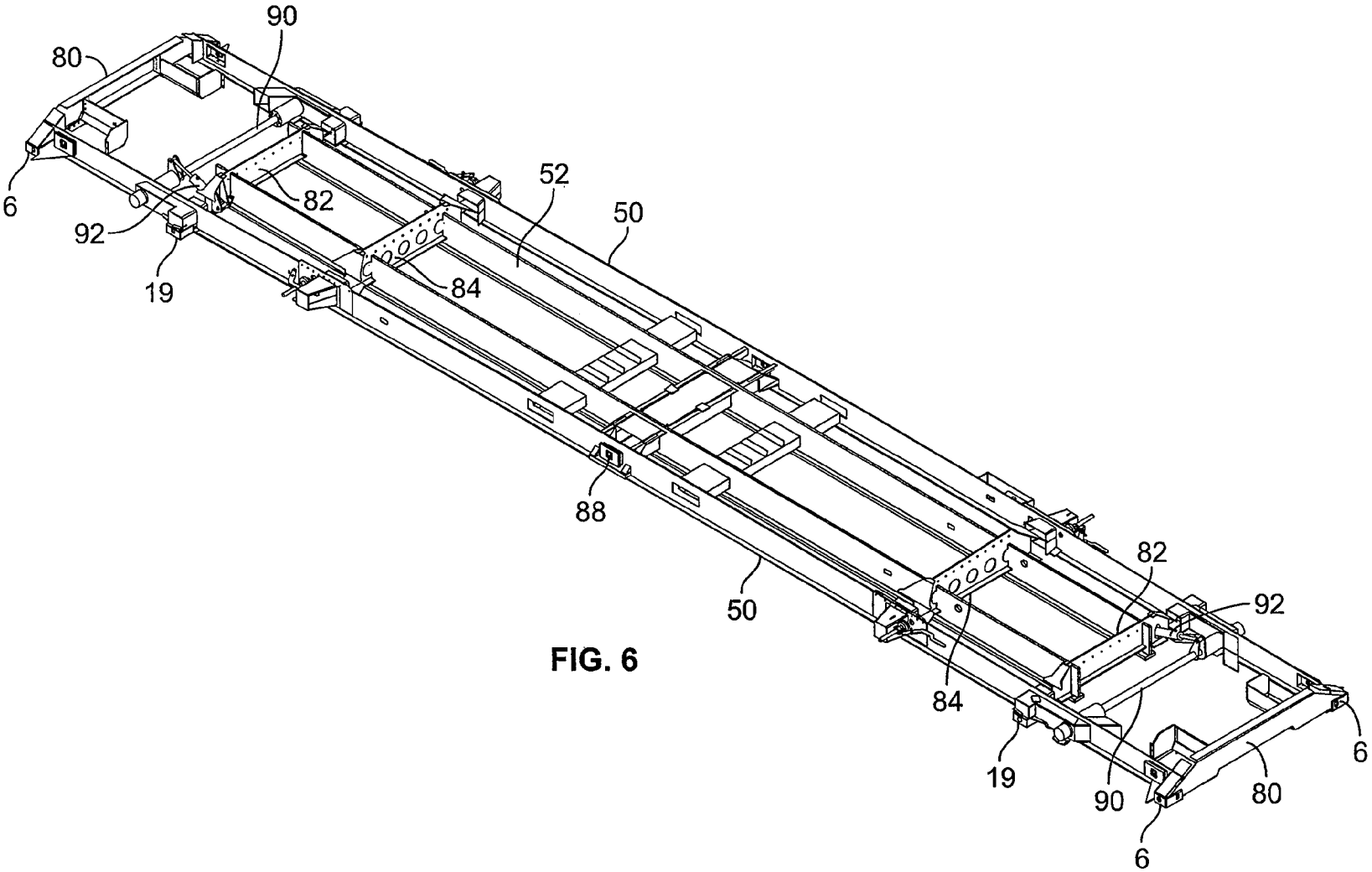
FIG. 6 is a cutaway view of a collapsible intermodal container with the deck surface and arm structure removed to reveal underlying chassis components.

FIG. 6 is a cutaway view of a collapsible intermodal container with the deck surface removed to reveal underlying structural components. This container embodiment bears resemblance to certain embodiments illustrated in the '406 Application, but is used to illustrate a container subframe, which has many common features through all embodiments. This particular subframe features four beams: two main beams 50 and two interior beams 52. The main beams run the full 53-foot length of the container while the interior beams stop at the forty foot points. Each beam is comprised of a lower flange and a web, and may have an upper flange in some embodiments. The upper surface of the beams are joined to the deck bed, which has been removed in FIG. 6.

Connecting the beams are a series of crossmembers that also run underneath the deck bed. End crossmembers 80 position the corner fitments fifty-three feet apart from one another and connect the ends of the main beams 50. Forty foot crossmembers 82 position the stacking block receivers 19 (also referred to as the forty foot stacking fitments) and connect the ends of the interior beams 52. They also extend to the main beams 50 and support a motor assembly 92 used to turn the axle 90. Locking point crossmembers 84 attach all four beams at the longitudinal point along the container where the inner braces 30 attach to and exert load upon the main beams 50. Finally, fork lift crossmembers 86 connect the beams at points near the longitudinal centerline of the container at a distance apart corresponding to the separation of forks on a standard forklift. Fork lift crossmembers 86 are hollow and allow a container to be manipulated by a forklift when empty. Storage compartment 88 is illustrated at the center of the deck and may be used to store materials associated with load securement.

While conveniently spaced based on the support arm configuration of the illustrated embodiment, it will be understood that certain embodiments described herein may have more or less crossmembers, and may have more or less beams. Typically, the crossmembers will be positioned to align with anticipated high-stress areas based on the design and layout of the above-deck structure. Some embodiments may require more or stronger material to comprise the crossmembers.

The underlying chassis structure may also package hydraulic components, motor assemblies, or other mechanisms for manipulating the above-deck structure of the platform container. In the chassis structure of FIG. 6, axle 90 extends through each main beam 50, and is driven by hydraulic motor 92 mounted off of the forty foot crossmember 82. Though not shown, this axle 90 would be connected to an above deck structure (such as a support arm), and would be used to manipulate the structure between load, haul and storage positions. This type of drive mechanism is more fully described in the '406 Application. As will be seen, other embodiments have different drive mechanisms, or none at all.

Figure 7:
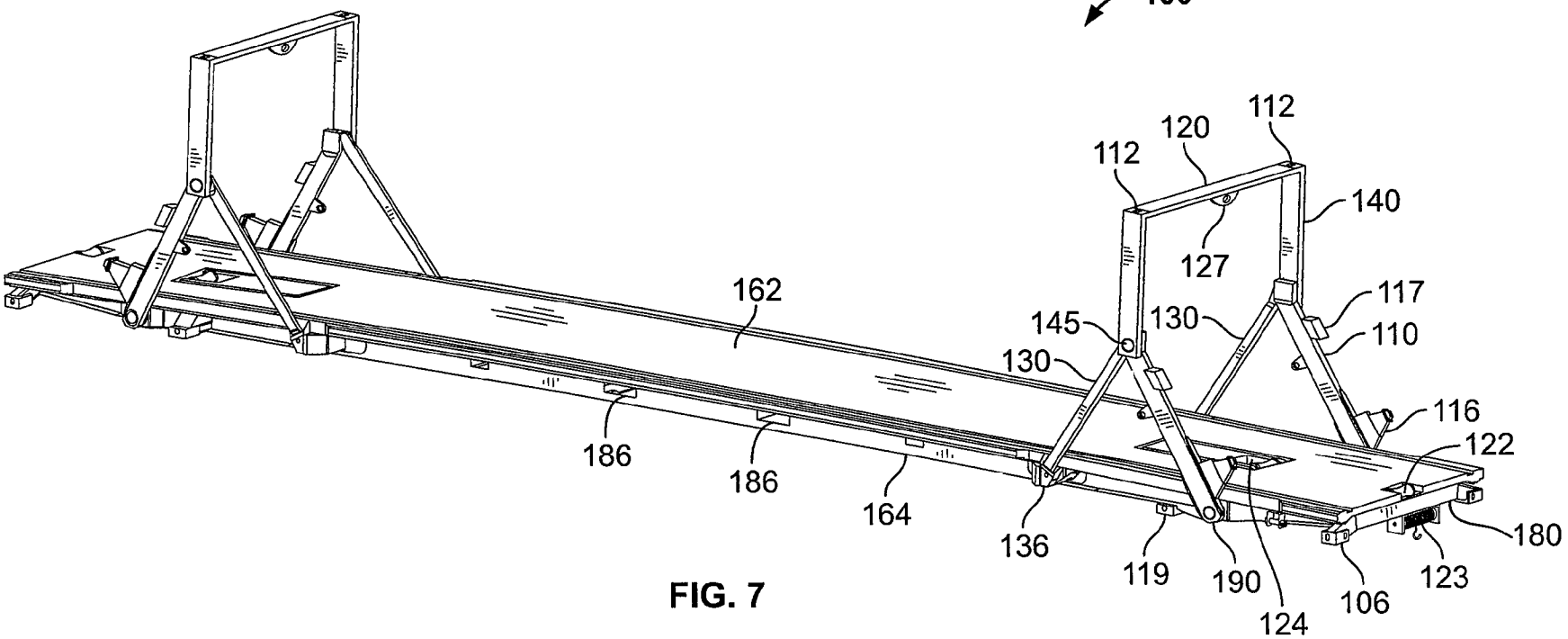
FIG. 7 is an isometric view of a first embodiment of a collapsible intermodal container in a haul configuration.

FIG. 7 illustrates a first embodiment of an intermodal container, which is a distinct variation off of that shown and described in detail in the '406 Application. Deck bed 162 sits atop main beams 164. Main beams connect a variety of crossmembers such as fork lift crossmembers 186, end crossmembers 180 and others not shown. Axle 190 connects outer braces 110 and causes them to rotate. The above-deck structure has three primary components: outer braces 110, inner braces 130 and extension posts 140. These components are all pinned and capable of rotation with respect to one another, at main joints 145. Similar to certain embodiments in the '406 Application, the inner and outer braces come together to form an "A-frame" construction. However, they meet roughly four feet lower than where the lifting fitments 112 must be placed. Instead of being located where the A-frame joins, the lifting fitments are positioned by an extension assembly comprising extensions posts 140 and connector beam 120. Corner fitments 106 and forty-foot stacking fitments 119 are in their usual locations.

FIG. 7 shows the container 100 in the Haul position. Here, the extension posts 140 are erect, placing the lifting fitments 112 into their proper position for crane lifting. The deck bed 162 can accommodate a full length load in this configuration. There are two cutaways in the deck surface where a cable routing mechanism 124 resides. The cable 123 is coiled and located off of the end of the deck 162. There is also a cable wheel 122 to feed the cable over the end of the deck and end crossmember 180 to prevent friction. This cable assembly is used to assist with manipulation of the extensions posts 140 and connector beam 120.

Figure 8:
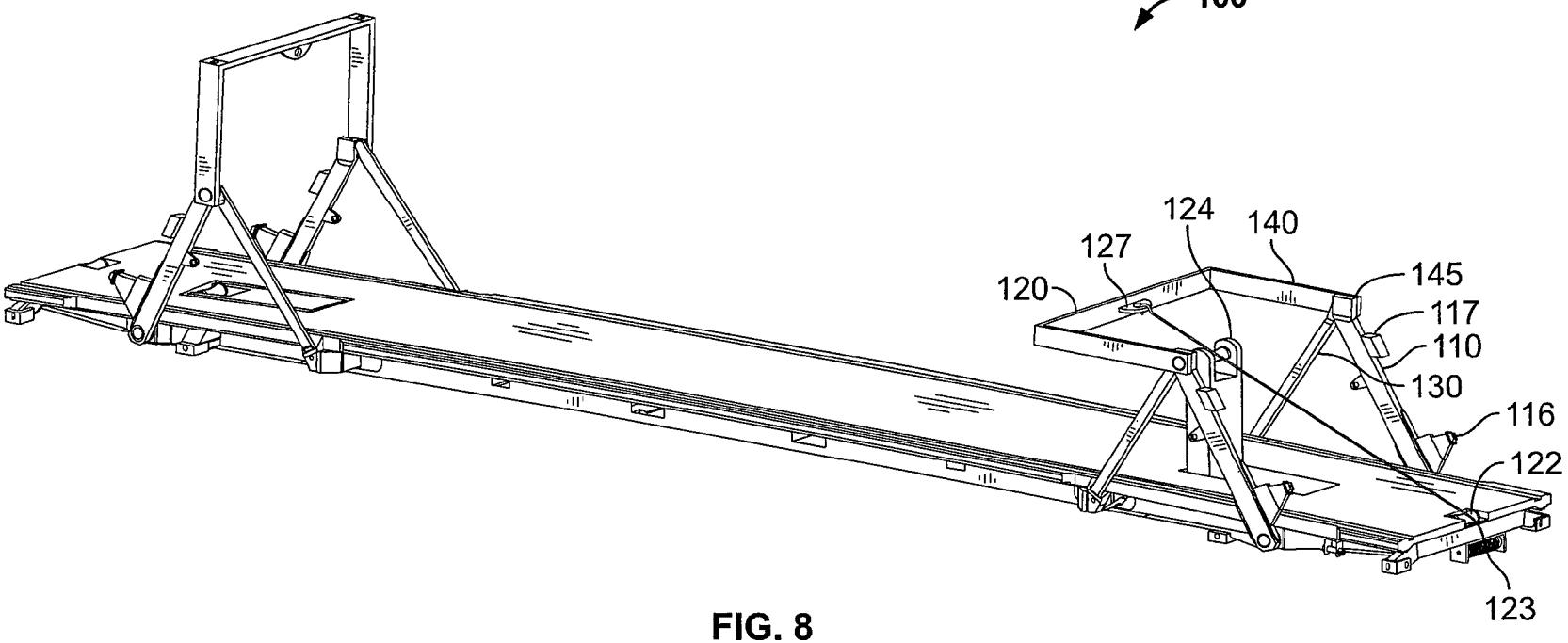
FIG. 8 is an isometric view of the collapsible intermodal container of FIG. 7, showing a transition to a storage configuration.

FIG. 8 displays the container 100 of FIG. 7 as it begins to be transitioned to a storage position where the above-deck components are flattened out, providing for ease of storage and empty transport. Like the embodiments of the '406 Application, container 100 also utilizes an axle to rotate the braces between positions. However, the extension posts 140 operate separately from the axle. Though they could be manually operated, a mechanical assist is provided to help manipulate the extension assembly in the form of a cable 123. Cable 123 would be let out and reeled in by a winch (not shown), and can be operated by any traditional means, such as by slaving off of a nearby engine or motor. At the end of the cable is a hook that latches to connector beam bracket 127 centered in the connector beam 120. The cable 123 is routed across a wheel 122 in the deck bed 162.

A locking mechanism (not shown) holds the extension posts erect in the haul position. Once unlocked, and with the cable hooked up, the extension posts are moved off top-dead center and the cable takes over. As the cable is let out, the extension assembly will rotate about the main joint 145, dropping the assembly down toward the inboard braces 130. A cable routing mechanism 124 that is normally inset into the deck bed 162 is rocked up into place to position a pulley 125 for routing the cable 123. The cable routing mechanism 124 prevents the connector beam 120 from simply falling down against the inboard braces 130 once past a position where the cable would otherwise no longer let out. Instead, it this allow the cable to continue to let out even as bracket 127 starts to get closer to the end of the deck bed 162 as the extension assembly drops below parallel with the deck bed. Once the connector beam 120 comes to rest against the inner braces 130, the cable 123 will slacken and may be unhooked from the bracket 127 and recoiled.

Figure 8A:
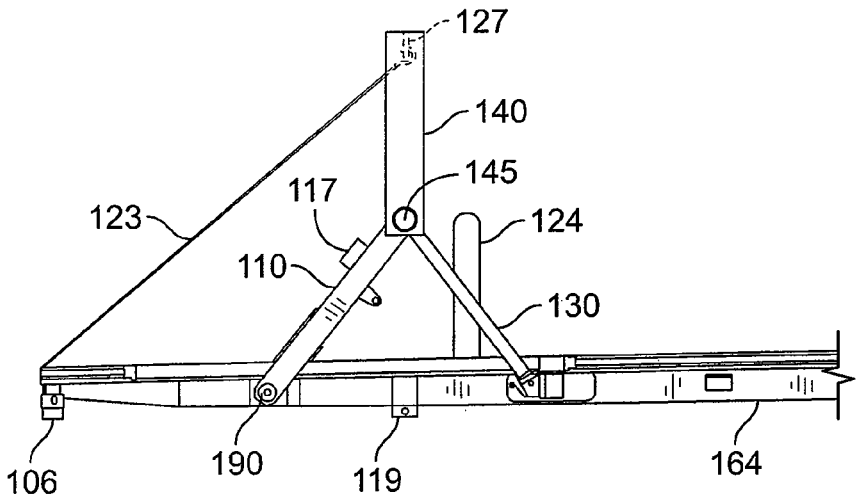
FIGS. 8A-8C are side views of a portion of the collapsible intermodal container of FIG. 7, showing additional steps in transition to a storage configuration.
Figure 8B:
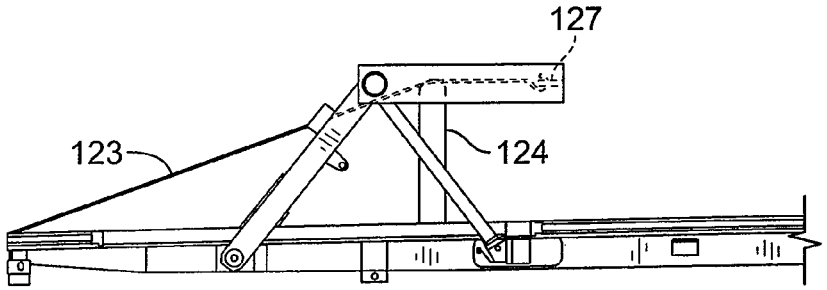
Figure 8C:
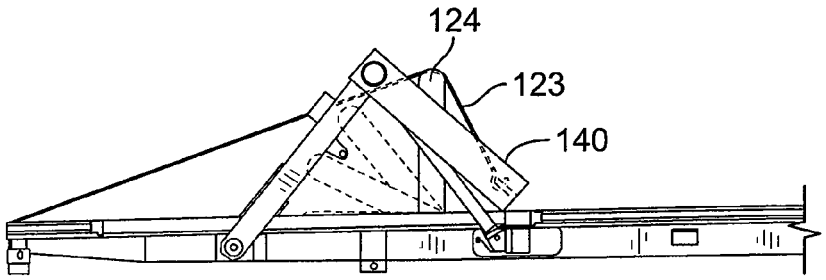

Manipulation of this embodiment from a haul position toward a storage position is further illustrated in FIGS. 8A, 8B and 8C. As shown in side views, the cable 123 initially runs directly up to the connector beam bracket 127. As the cable is let out and the connector beam drops, the cable comes into contact with the pulley at the top of the cable routing mechanism 124 (FIG. 8B). As the cable continues to let out, the connector beam continues to lower down until it comes to rest against the inner brace 130. Cable routing assembly 124 is laterally centered in the deck bed, so it does not come into contact with any of the braces. Furthermore, it need not be a particularly heavy member because it only has to support the unloaded weight of the extension posts 140 and the connector beam 120. It is mechanically assisted by a spring assembly (not shown) located below the deck surface to pop into its upright position, and is then manually lowered (thus reloading the spring).

Figure 9:
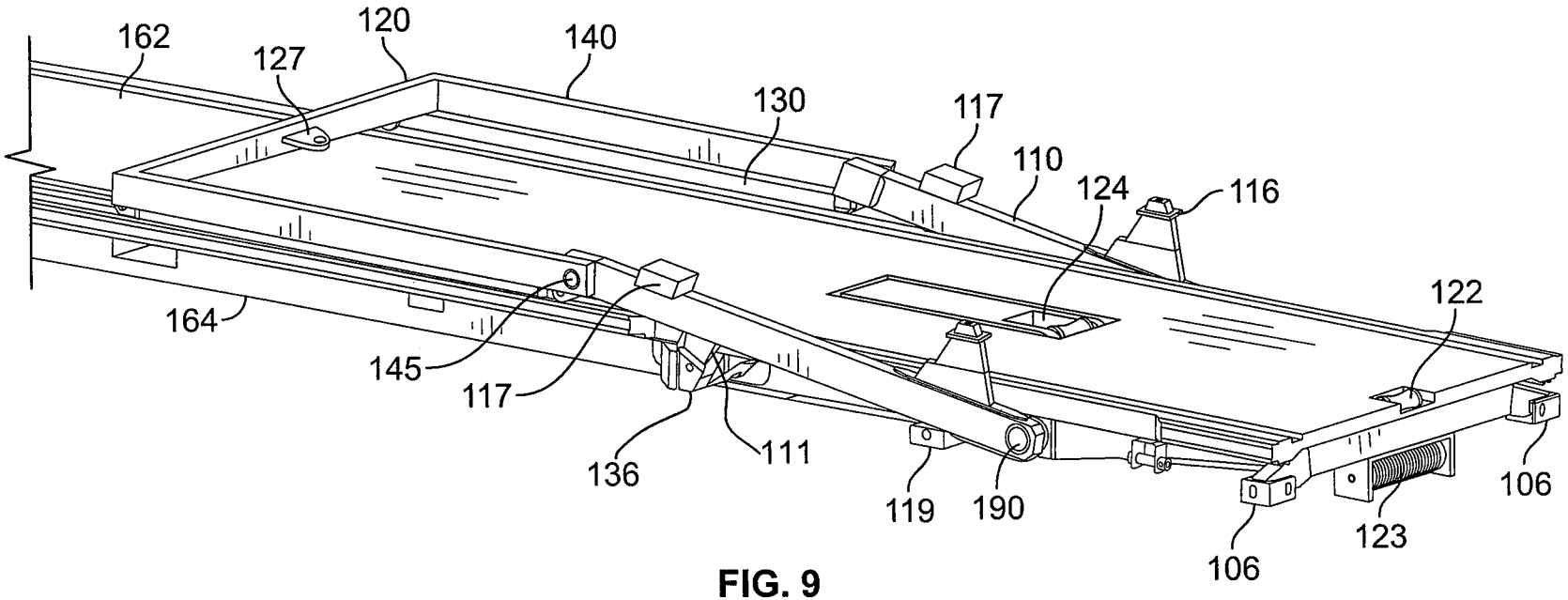
FIG. 9 is an isometric view of one side of the collapsible intermodal container of FIG. 7 in a storage configuration.
Figure 10:
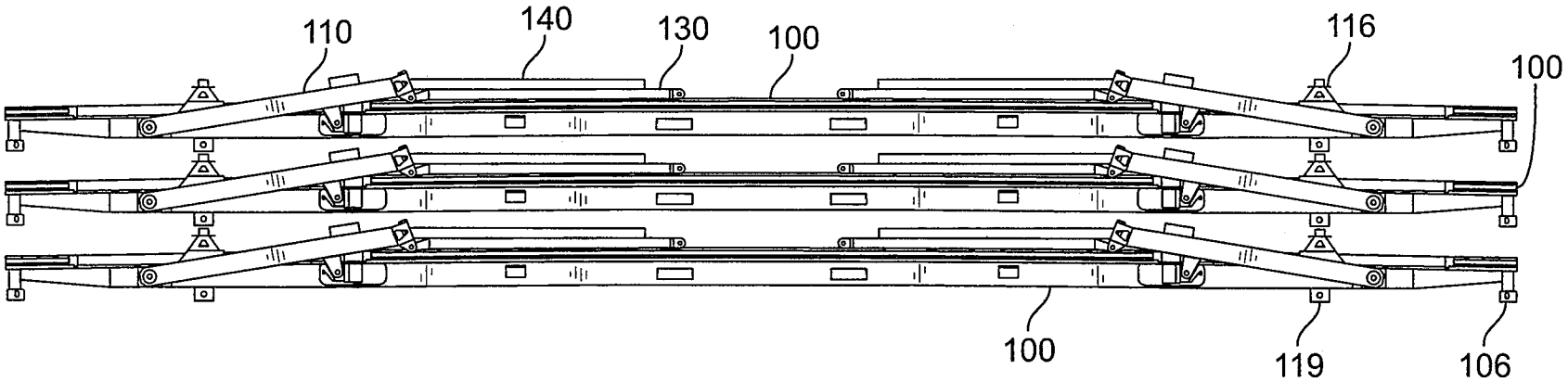
FIG. 10 is a side view of several of the collapsible intermodal containers of FIG. 7 stacked together.

Once the extension assembly has been lowered and the cable is reeled in, the inner and outer braces are lowered down via the axle 190, just as set forth in the '406 Application. This aligns the stacking blocks 116 at the forty foot points just above the forty foot stacking fitments 119, as shown in FIG. 9. FIG. 9 also shows how the inner braces 130 rest along the deck surface 162, with the extension posts 140 resting over them. In similar fashion as that explained in the '406 Application, stowage lock brackets 111 mounted on the outer braces 110 fix into haul position brace brackets 136 mounted on the main beams 164. Because the outer braces are shorter in this embodiment than as explained in the '406 Application, the positioning of these respective brackets along the components to which they are mounted is adjusted. Finally, cable routing mechanism 124 has been lowered back down into its storage position flush to the deck bed 162. FIG. 10 illustrates how several containers 100 can be stacked when in this storage configuration.

Figure 11:
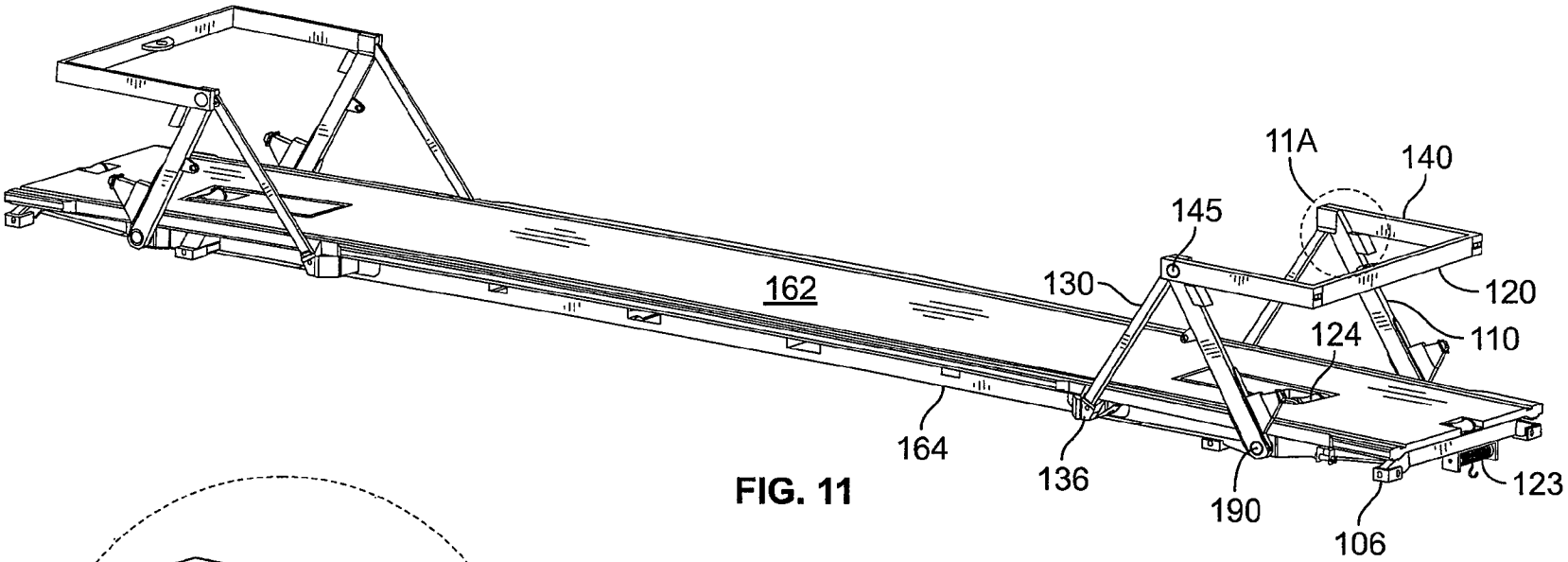
FIG. 11 is an isometric view of the collapsible intermodal container of FIG. 7 in a load configuration.
Figure 11A:
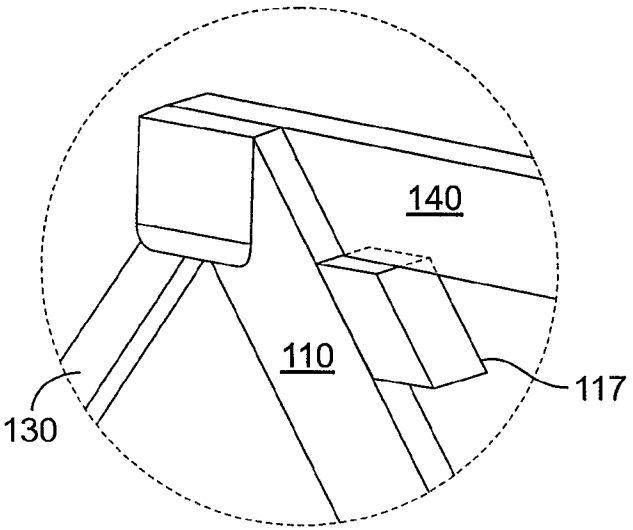
FIG. 11A is a close-up view of a portion of the container of FIG. 11, highlighting the extension block function.
Figure 12:
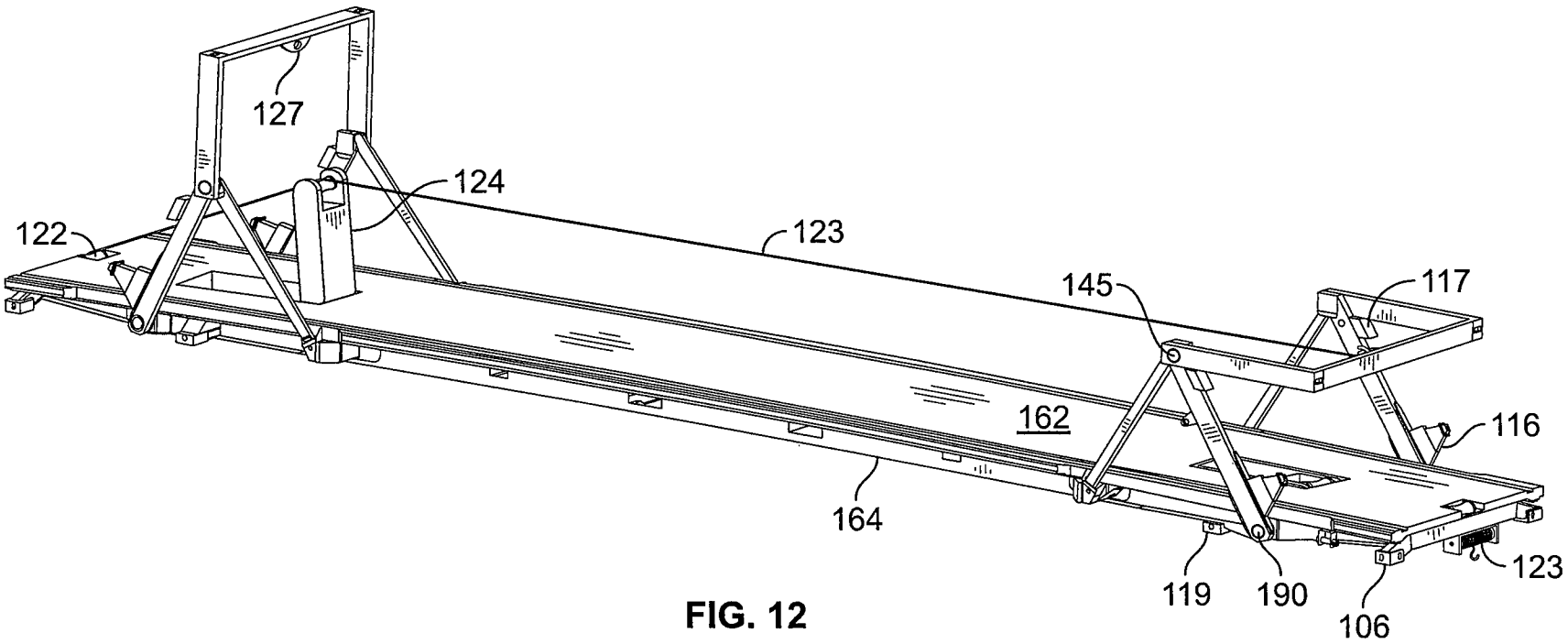
FIG. 12 is an isometric view of the collapsible intermodal container of FIG. 7, showing a transition between a load and a haul configuration.

Container 100 also has a load configuration, as illustrated in FIG. 11. Instead of using the axle 190 to rotate the outboard braces 110 toward the ends of the container 100 as was taught in the '406 Application, here only the extension assemblies need to move. No power to the axle 190 or associated motor 192 is needed, and the inner braces 130 need not be unlocked from the haul position brace brackets 136. Instead, the extension posts 140 rotate outboard about the main joint 145 until they hit extension blocks 117, which form a mechanical stop. The extension blocks 117 may be permanently mounted on the outboard braces 110, such as by welding. Once resting on the mechanical stop, the extension assembly is out of the way to facilitate top loading of materials up to nearly 50' in length. As shown in FIG. 12, if desired, cable 123 may again be utilized to assist with the manipulation of the extension assembly. However, the cable 123 and winch on the opposite side of the container 100 is used in this case. Once a load is in place, it may not be possible to use the cable 123 to raise the extension assembly back up into position. In these cases, the extension assembly would have to be returned manually to the upright position in the embodiment as shown. One advantage to this embodiment over that described in the '406 Application is the ability to shift the container into the load configuration without use of or access to the on-board hydraulic motor. It may be difficult to access the controls for this motor when the container is loaded into a rail well car, so this embodiment allows loading/unloading without removal of the platform from a well car rail chassis.

Figure 12A:
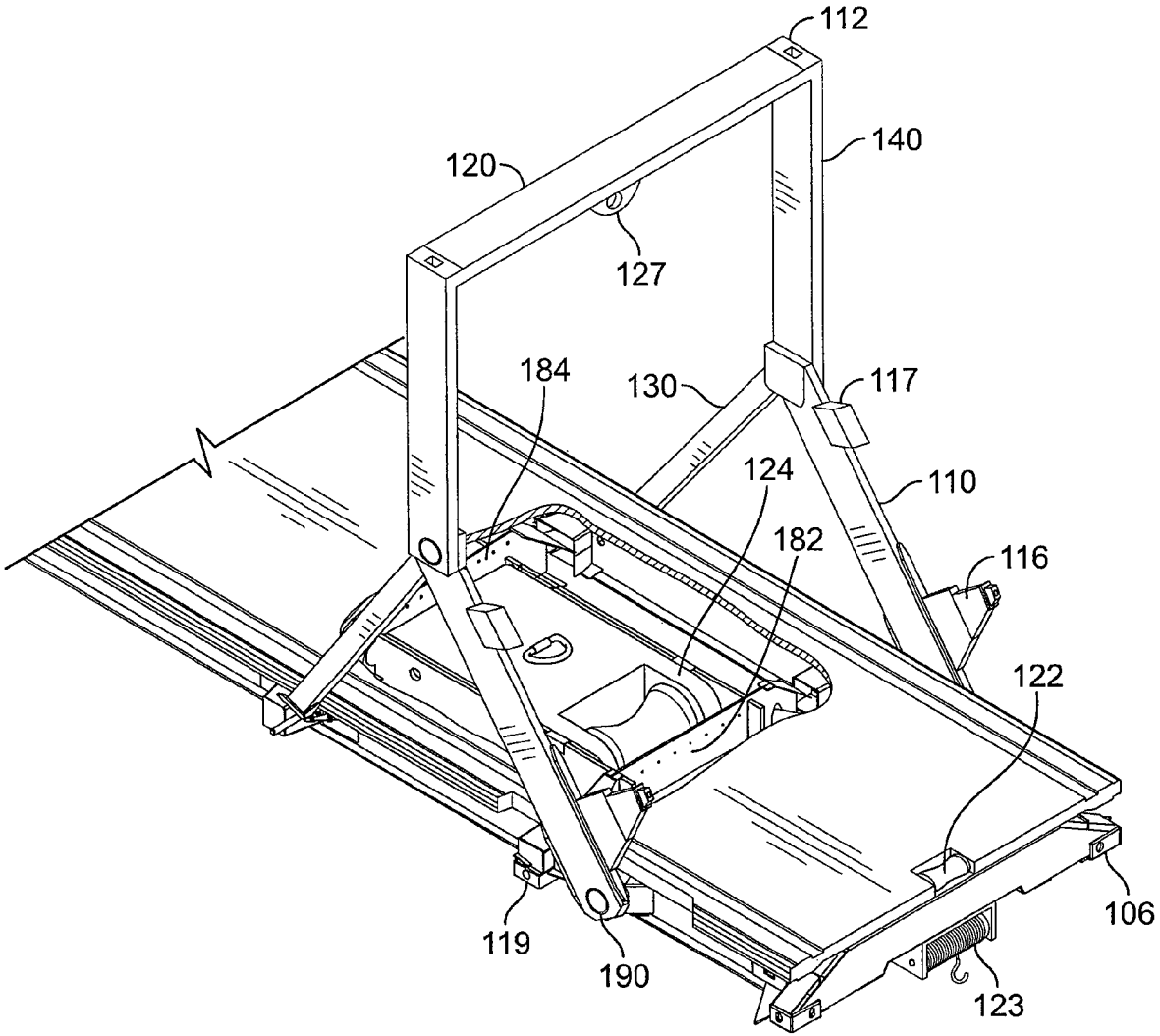
FIG. 12A is an isometric view of a corner of the collapsible intermodal container of FIG. 7, with a portion of the deck removed to reveal certain underlying components.

FIG. 12A provides more detail on the storage position of the cable routing mechanism 124. As shown, it is positioned between the locking point crossmember 184 and the forty foot crossmember 182. A torsion spring (not shown) is coiled to provide constant upward pressure to erect the mechanism when released. A lock mechanism within the storage housing holds the cable routing mechanism 124 down, and must be released before it will pop up for use.

Figure 13:
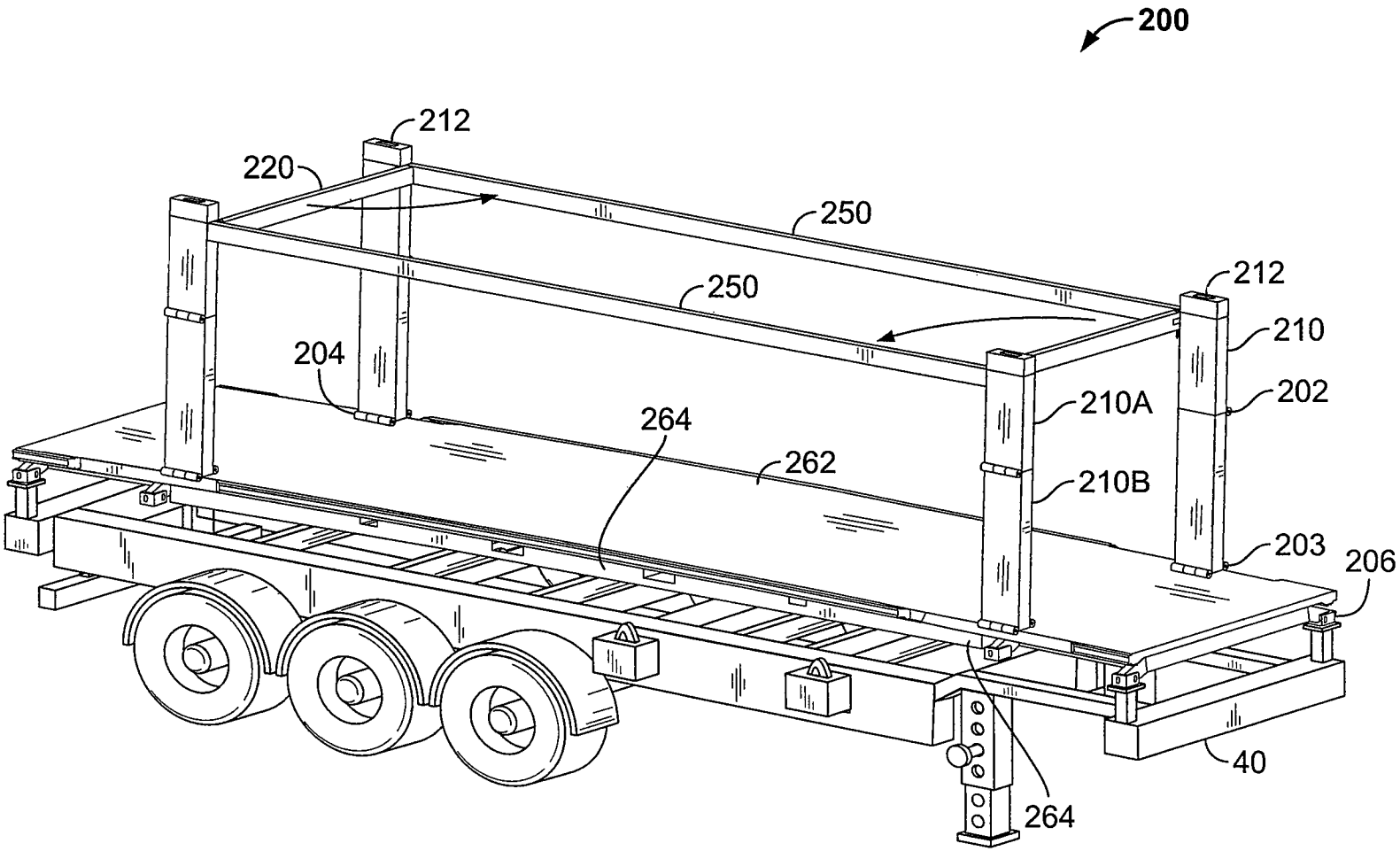
FIG. 13 is an isometric view of a second embodiment of a collapsible intermodal container in a haul configuration.

FIG. 13 illustrates a second embodiment of an intermodal container 200 that also has haul, load and storage positions. As shown, this embodiment is depicted in its haul position atop a trailer chassis, such as that shown in FIG. 3. Main posts 210 extend from the forty foot points on the deck bed 262. Each main post comprises an upper portion 210A and a lower portion 210B. The upper and lower portions are connected by upper hinge 202. Though shown as a small external hinge, hinge 202 could be formed from integral (cast or extruded) extensions of the upper and lower portions, with a non-integral pin fitting through the formations to lock them together. Alternatively, the hinge components could be bolted or welded on, but the connection must be strong enough to hold the suspended weight of the upper main posts 210A as well as a longitudinal connector 250 and a connector beam 220. The longitudinal connectors 250 join together the tops of two main posts 210 on the same side of a container, while the connector beams 220 join together the tops of two main posts 210 that are across from each other. The longitudinal connectors remain fixed to the posts 210 at each end. The connector beams 220 remain hinged to one post, but come unhinged from the other post to allow the connector beams 220 to swing across and align with the longitudinal connectors 250 to facilitate movement of the container 200 to different configurations.

The lower section of the main post 210B sets on top of the deck bed 262 at a point directly over the main beam 264. Because the deck bed is typically formed of hollow aluminum extrusions, the deck bed 262 may require a localized solid support between the post 210 and the main beam 264 to avoid crushing or stretching the localized portion of the deck bed during operations. The lower main post 210B has an outer hinge 203 similar to hinge 202 at its upper end. The outer hinge 203 connects the post 210 to the deck bed 262 during haul, load and transitions between these positions. There is also an inner hinge 204 that is used to connect the main posts 210 to the deck bed in the storage configuration, and in transition between storage and haul. The main post may utilize both inner hinge 204 and outer hinge 203 to hold the main post to the deck bed in the haul configuration if desired. Because, as will be seen, lower main post 210B must rotate about both hinges in different operations, the hinges not being rotated about must be unpinned so as to allow this manipulation.

Figure 14:
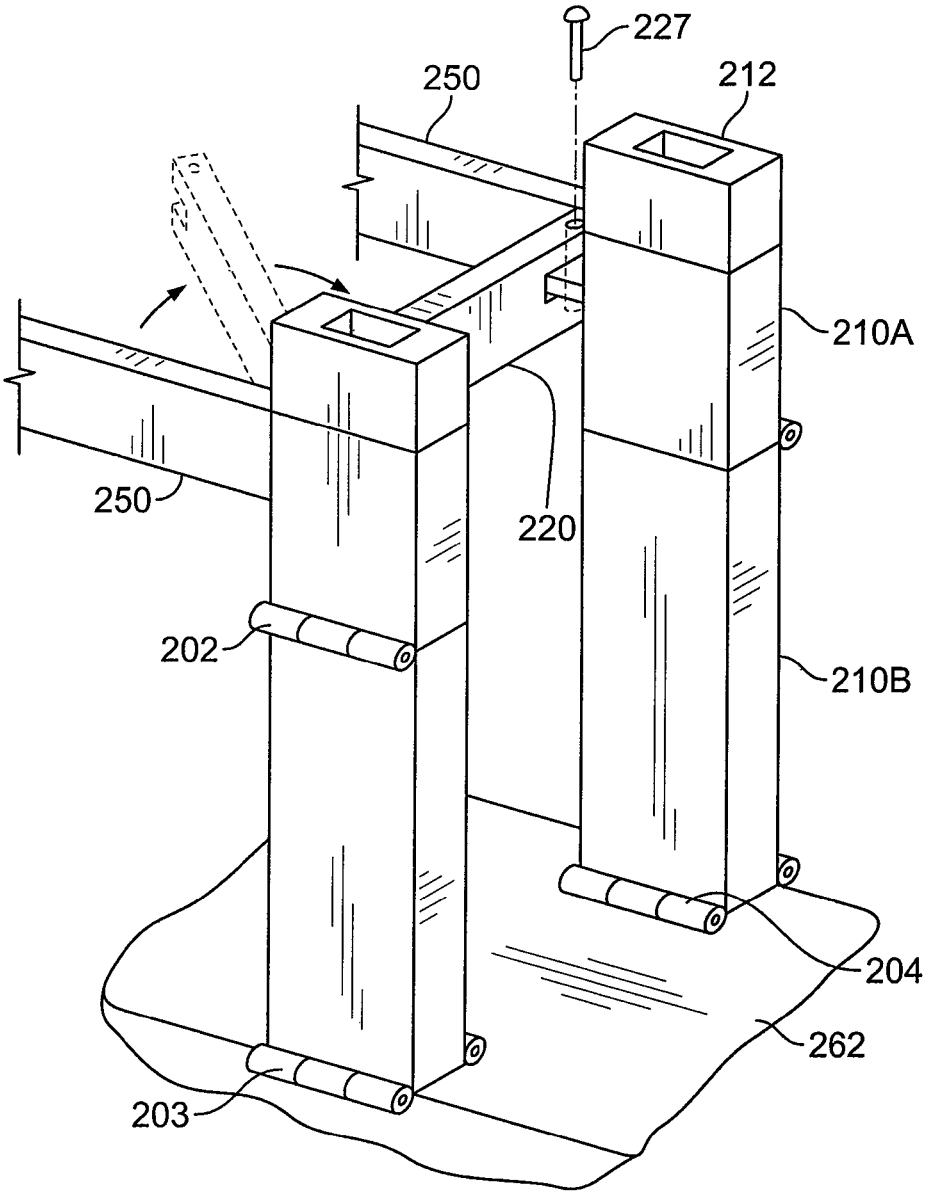
FIG. 14 is an isometric view of a portion of the collapsible intermodal container of FIG. 13, showing a transition to a storage or load configuration.

FIG. 14 illustrates an isometric view of one end of the container 200 in the haul position, with the hinges emphasized for effect. As shown, a connector beam bracket 226 extends from the lifting fitment 212 on the top of the far-side upper main post 210A. A locking pin 227 is used to secure the connector beam 220 to the bracket 226. When transition to storage or load configuration is desired, the pin 227 is removed and the connector beam 220 is swung across the deck bed 262 until it aligns with the longitudinal connector 250. The beam 220 may be separately pinned or affixed to the connector 250 once aligned.

Figure 14A:
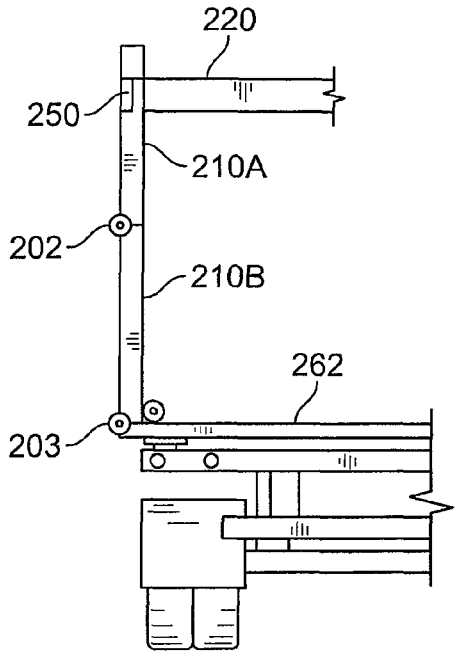
FIGS. 14A-14D are end views of the collapsible intermodal container of FIG. 13, showing additional steps in a transition from a haul to a load configuration.
Figure 14B:
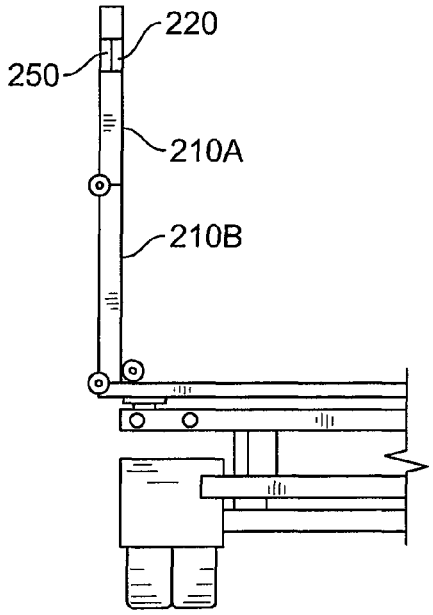
Figure 14C:
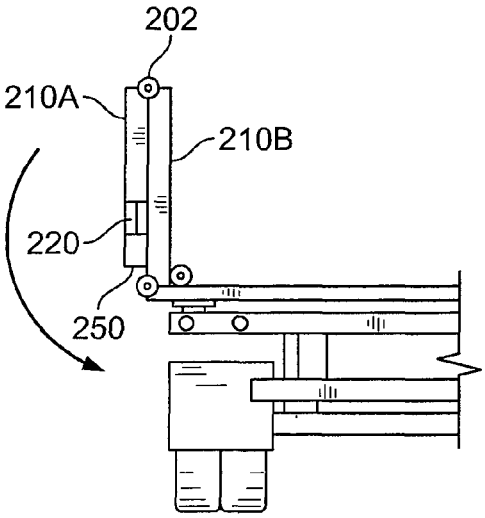

FIGS. 14A-14D show transitional steps of container 200 being changed from a haul configuration to a load configuration from an end view. In FIG. 14A, the connector beam 220 is seen extending across the trailer chassis 260, with the post sections 210A and 210B erect. In FIG. 14B, the connector beam 220 has been swung over to align with the longitudinal connector 250. In FIG. 14C, the upper portion of the main post 210A has been dropped down using upper hinge 202 such that it aligns with lower main post 210B. Here, the upper main post sections 210A, the connector beam 220 and the longitudinal connector 250 all three move as a complete assembly. Once in place, this assembly is attached to the outer surface of the lower main posts 210B at each end of the container 200 via conventional means such as locking pins (not shown). The upper assembly and the lower main posts 210B collectively form a lower assembly.

Figure 14D:
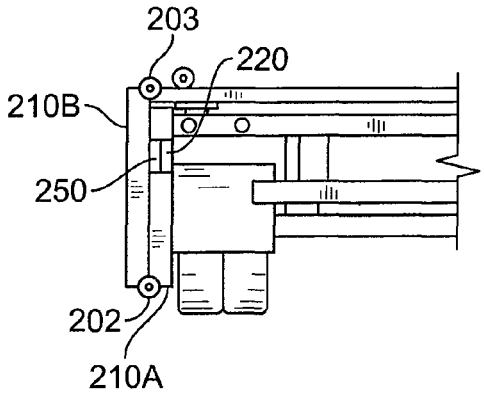
Figure 15:
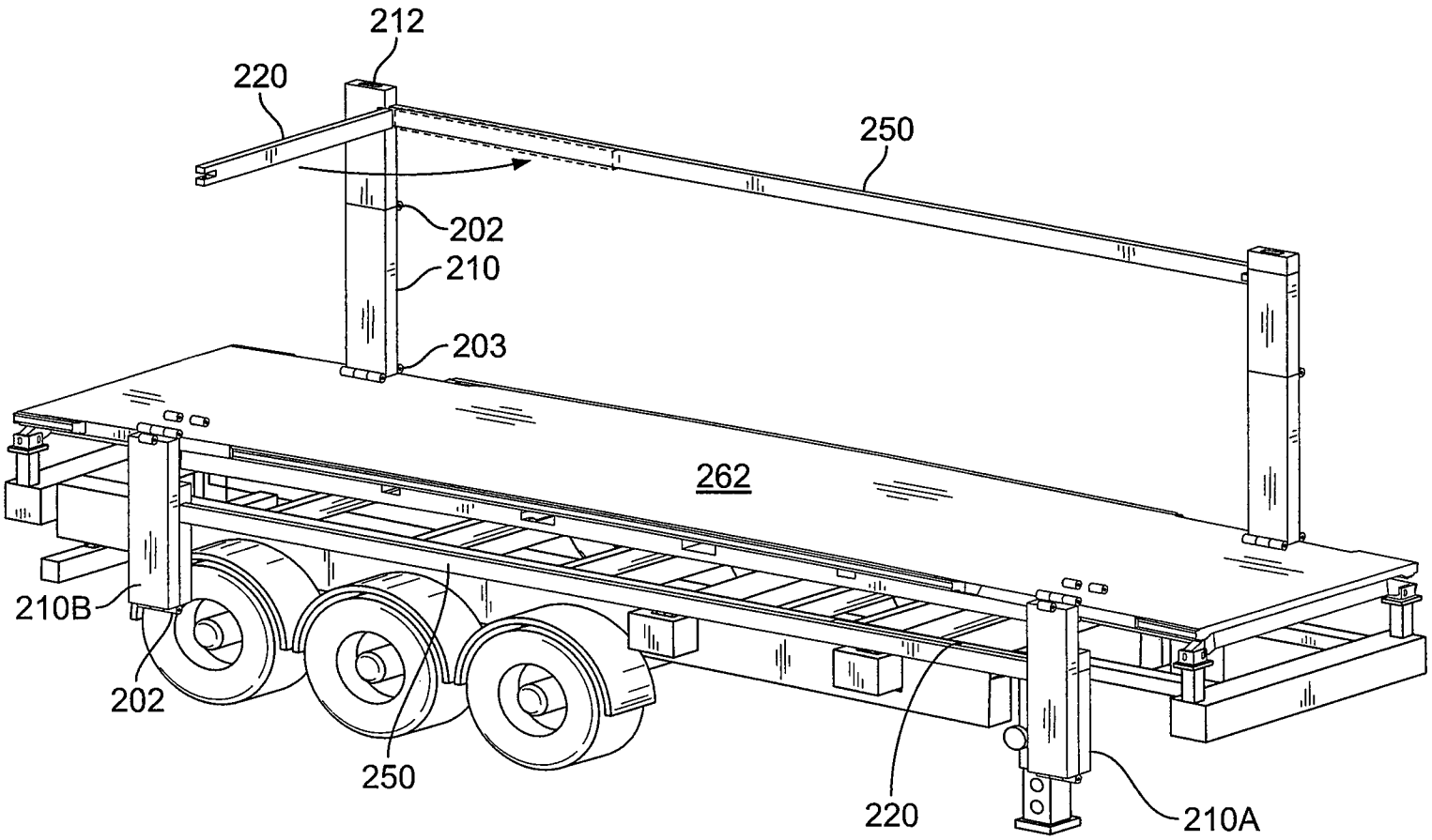
FIG. 15 is an isometric view of the collapsible intermodal container of FIG. 13 in a load configuration.
Figure 16:
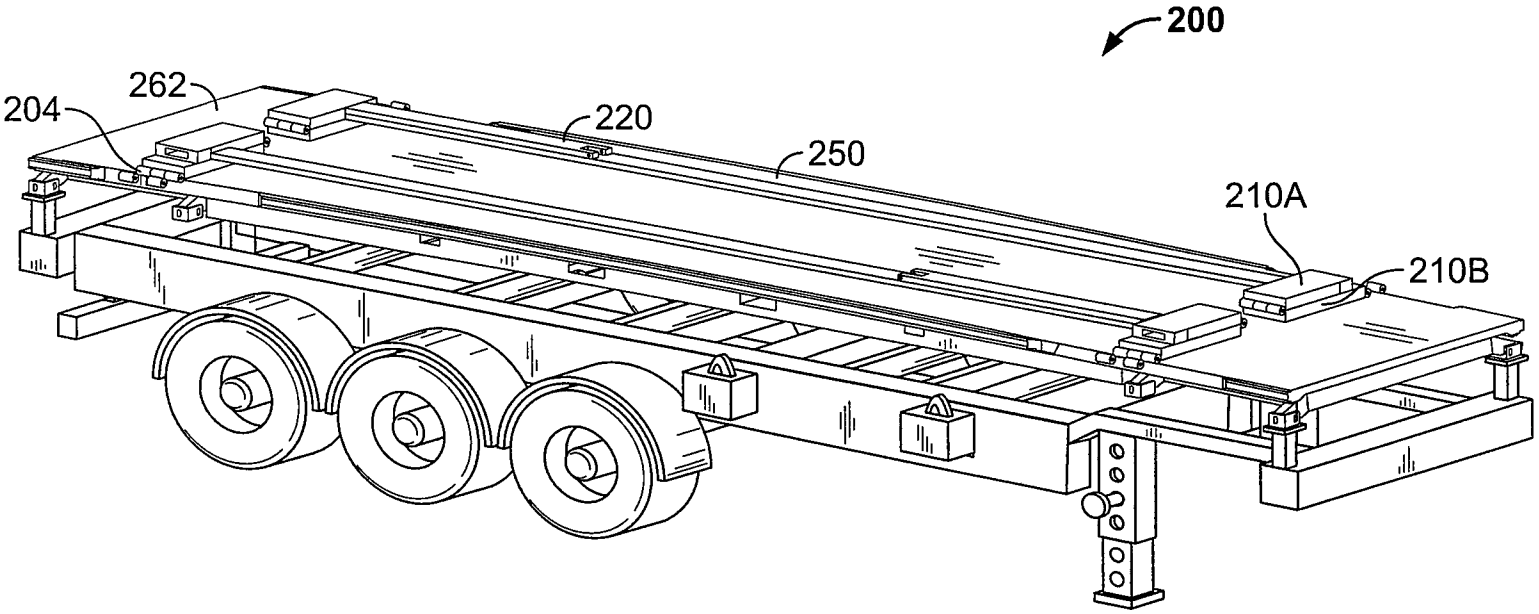
FIG. 16 is an isometric view of the collapsible intermodal container of FIG. 13 in a storage configuration.

From the position of FIG. 14C, the lower assembly can fold either outward to a load position (as shown in FIG. 14D) or inward to a storage position (as shown in FIG. 16. In the load position, rotation about outer hinge 203 allows the lower assembly to hang down off of the trailer chassis 260. From here, the entire surface of the deck bed 262 is open to side or top loading from the left side of the trailer. Though the right side is not shown, it would typically be left in the haul configuration unless loading from both sides is desired. The resulting configuration is shown in a full isometric view in FIG. 15.

FIG. 16 shows the same embodiment in a storage configuration. Movement from haul to storage starts much the same as movement from haul to load. The connector beams 220 are swung across and fixed to the longitudinal connectors 250. The upper assemblies (each comprising a connector beam 220, a longitudinal connector 250 and two upper main post sections 210A) fold about upper hinge 202 to align with the lower main post sections 210B. From there, outer hinge 203 must be disconnected by removing the hinge pin (not shown) and inserting it into inner hinge 204 (not shown) (if a pin is not already present there). Then, the lower assemblies (each comprising an upper assembly and two lower main post sections 210B) fold inward about inner hinge 204 down onto the deck surface 262. Stacking blocks (not shown) with lifting fitments are then affixed to the deck bed 262 over the same reinforced area where main posts 210 usually sit. In this embodiment, the stacking blocks 216 would typically be removable and stored in a compartment beneath the deck surface when not in use.

Figure 17:
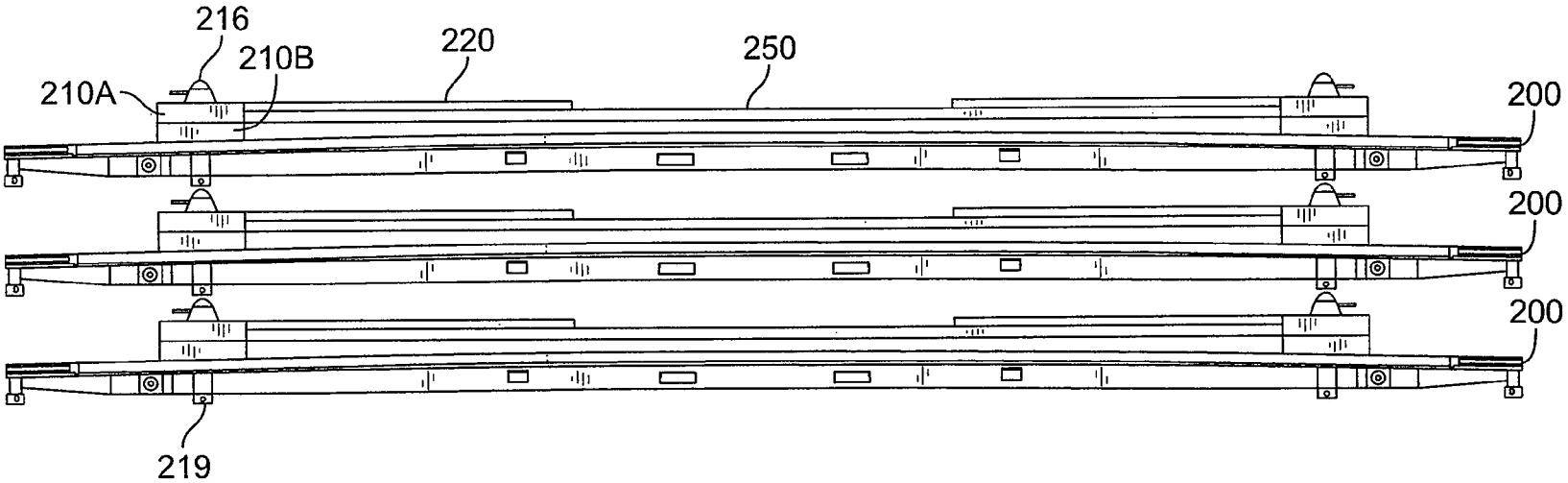
FIG. 17 is a side view of several of the collapsible intermodal containers of FIG. 13 stacked together.

FIG. 17 shows several intermodal containers 200 stacked on top of each other in the storage configuration. Because the main posts 210 always remain at the forty foot positions, the stacking blocks 216 are aligned with the stacking block receivers 219 to facilitate connection of one container to another.

Figure 18:
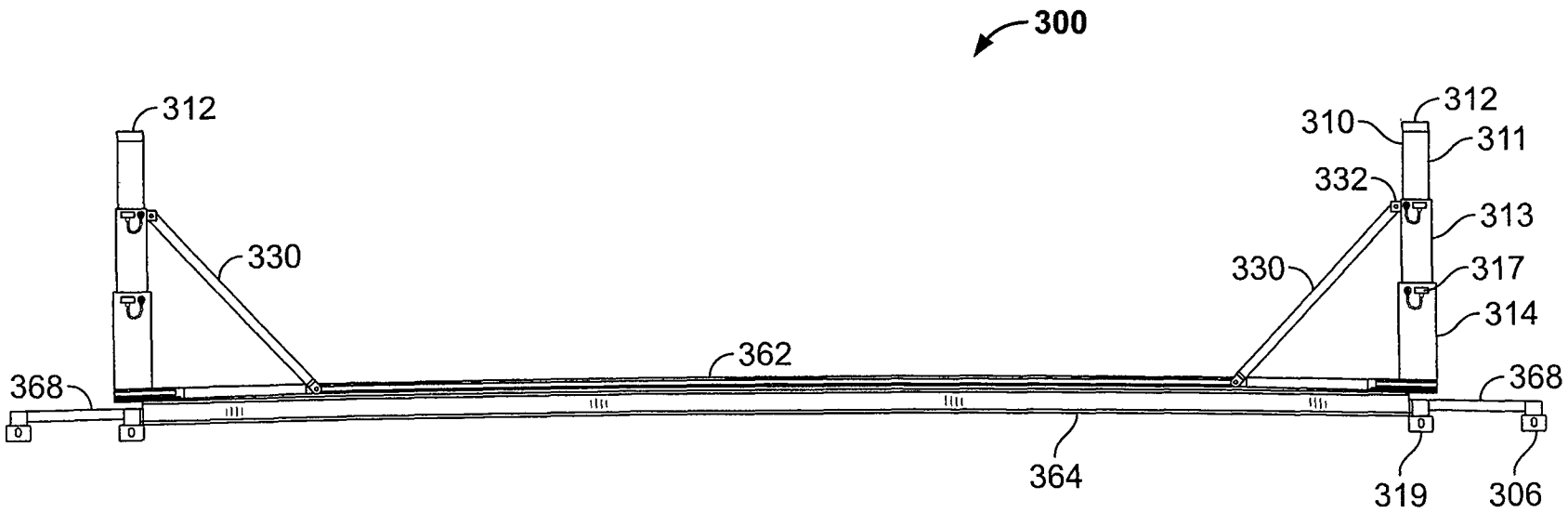
FIG. 18 is a side view of a third embodiment of a collapsible intermodal container in a haul configuration.

FIG. 18 illustrates a third embodiment of an intermodal container 300 or convertible cargo platform that also has haul, load and storage positions. In this embodiment, main posts 310 are extendable, and comprised of three separate sections 311, 313, and 314. Lower section 314 is permanently fixed to the rectangular deck bed 362 at the forty foot points over the main beam 364. Once again, a localized reinforcement may be used in place of or in addition to the extruded deck bed surface in between the main beam and the bottom of the main post. Middle section 313 and upper section 311 extend from and retract into the lower section telescopically under hydraulic power, as will be further explained. In FIG. 18, the main posts are shown in their fully erect position, each with a longitudinal brace 330 providing additional support for braking and acceleration loads. A lifting fitment 312 is positioned atop the main posts. Because there is no connector beam, this configuration serves as both a load and haul configuration. Though extended top-loading is enabled in this configuration, extended side loading is also possible by converting one side of the container 300 to a storage configuration, so long as the loading capability can clear the lower sections 314 of the main posts. As will be further explained, the container 300 has extendable ends 368 on either end which comprise a supplemental loading surface that allow the container to be converted from a 40' to a 53' length.

Figure 19:
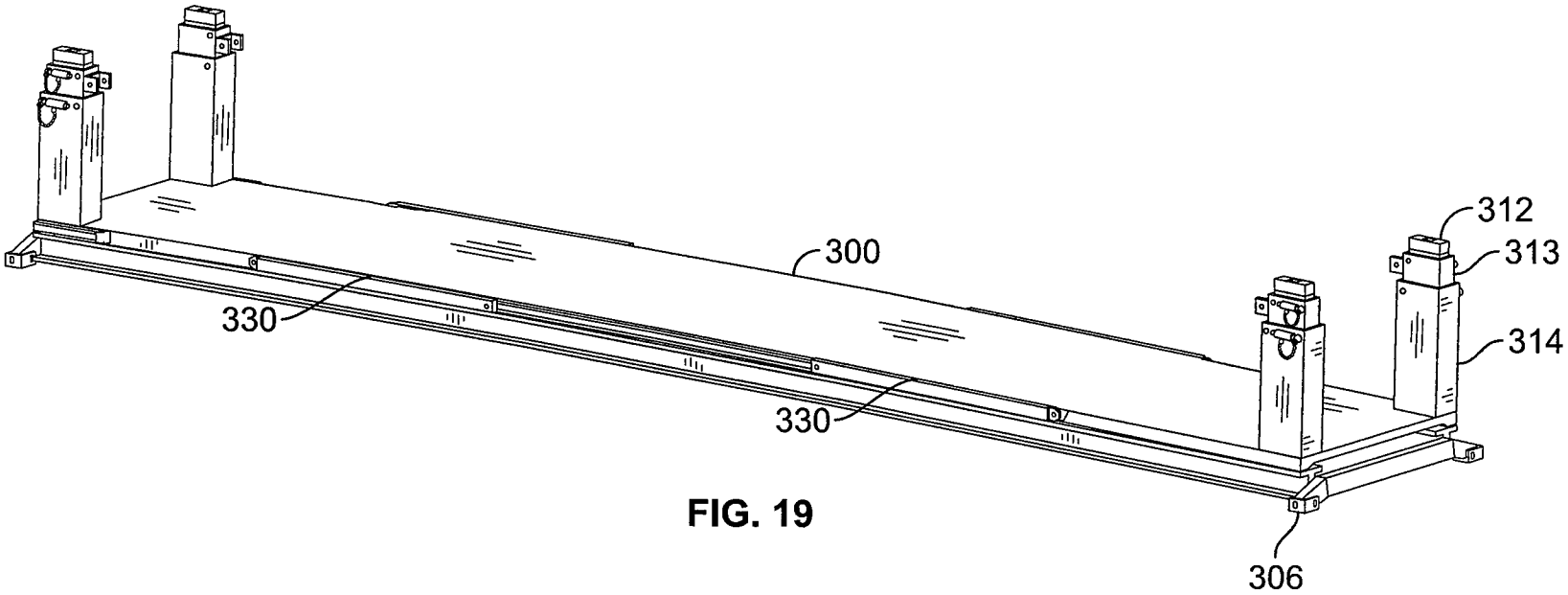
FIG. 19 is an isometric view of the collapsible intermodal container of FIG. 18 in a storage configuration.
Figure 21:
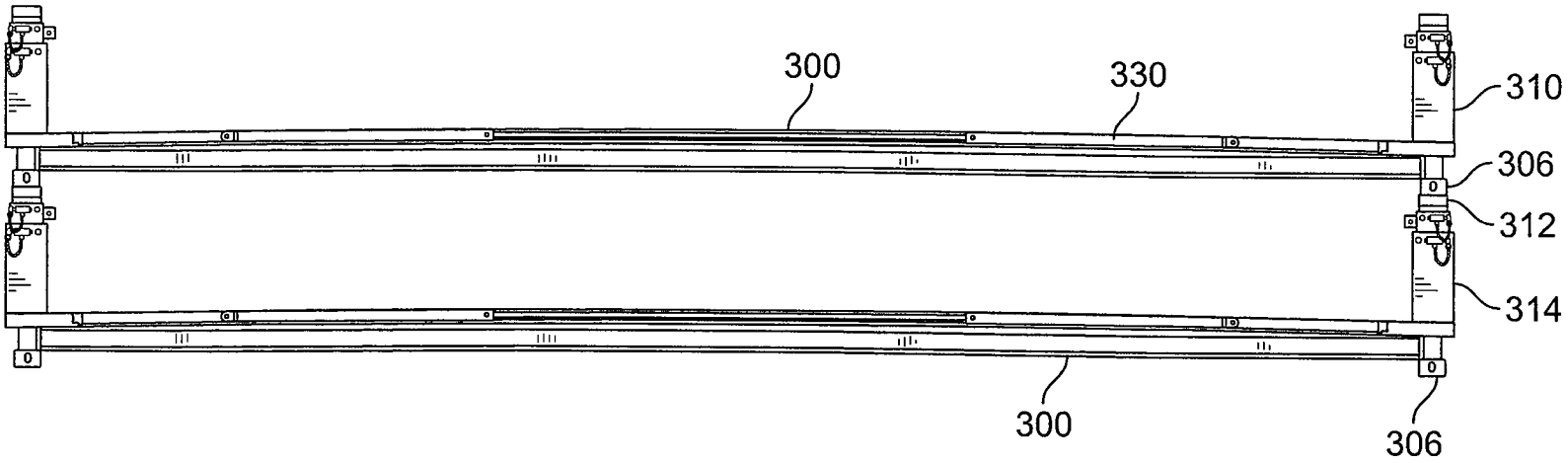
FIG. 21 is a side view of two of the collapsible intermodal containers of FIG. 18 in the storage position stacked together

FIG. 19 shows the container 300 in a storage configuration, where the extendable ends 368 are "in" and the main posts 310 have been lowered and pinned in place. Notably, container 300 does not have as flat a profile in the storage configurations as other embodiments disclosed herein. Thus, it is more feasible to stack container 300 two or three high for transport rather than three or four high. FIG. 21 shows a couple containers 300 stacked together at the 40' length.

Figures 20, 20A:
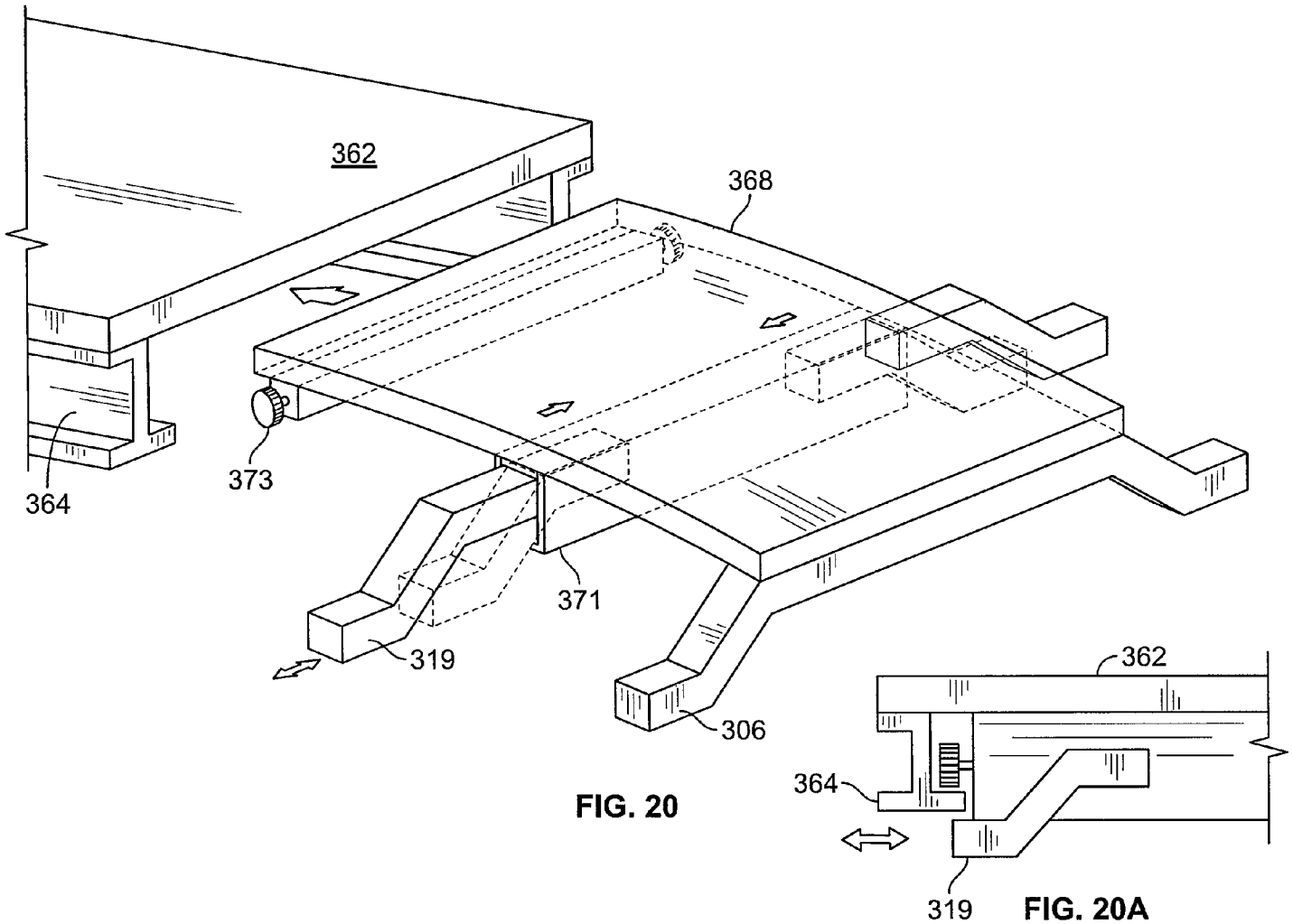
FIG. 20 is an exploded view of an end of the collapsible intermodal container of FIG. 18, where an extendable deck portion is shown pulled out from the main component of the deck.
FIG. 20A is an end view of a corner of the collapsible intermodal container of FIG. 18 showing the extendible end in relation to the main component of the deck.
Figure 22A:
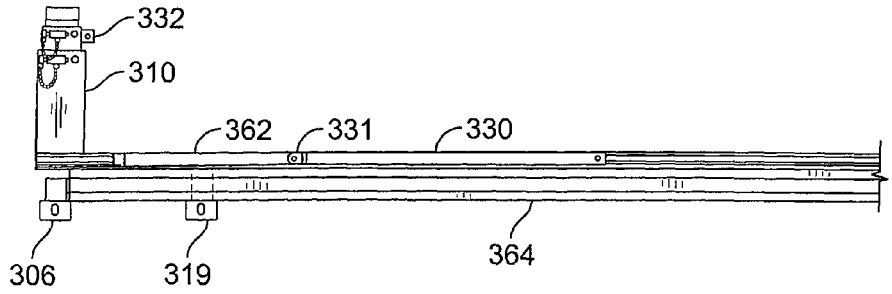
FIGS. 22A-22C are side views of the collapsible intermodal container of FIG. 18, showing steps in a transition from a storage to an extended load configuration.
Figure 22B:
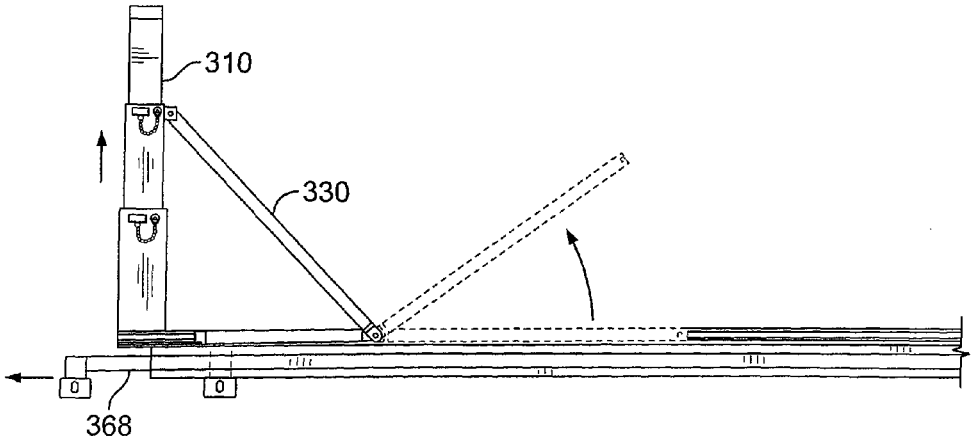
Figure 22C:
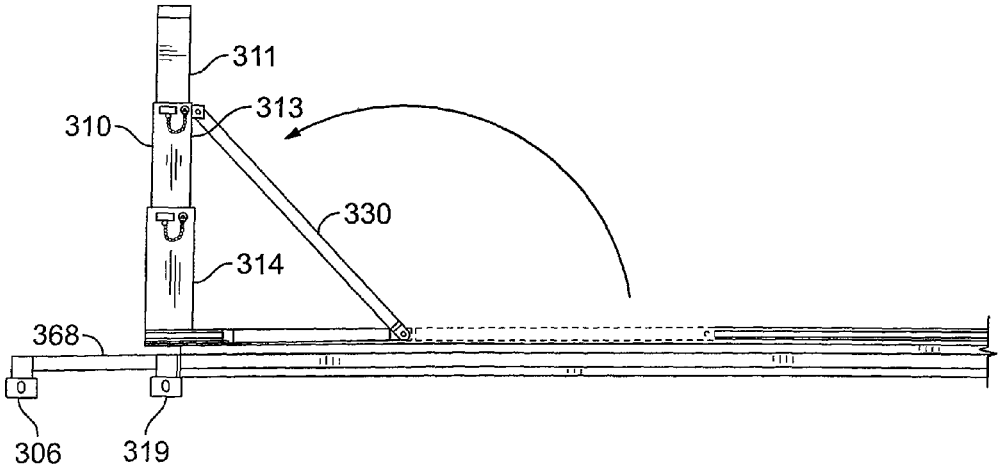

FIGS. 22A through 22C show conversion of the container 300 from a storage configuration to an extended haul configuration. In FIG. 22A, the main post 310 is retracted, the extendable end 368 is "in," and the longitudinal brace 330 is rotated inward and down about fixed pin 331 to lay along the deck bed 362. In FIG. 22B, the extendable end 368 is being pressed outboard, the main post 310 has been extended vertically, and the longitudinal brace is being swung up into position about fixed pin 331. In a preferred embodiment, the telescoping main posts are driven up and down under hydraulic pressure. A hydraulic motor (not shown) is located beneath the deck bed with hydraulic lines attached to the interior of the hollow lower section 314. As fluid is driven into the section 314, section 313 is extended upward out of the hollow lower section 314. A secondary hollow chamber in section 313 houses upper section 311 and is similarly filled with hydraulic pressurized fluid drive the upper section 311 out. Seperately, the extendable ends are on a piston rod assembly (such as shown in FIG. 30) beneath the deck that drives the ends 368 out and pulls them back in. As shown in FIG. 20, the extendable ends may be on rollers positioned within the web of the main beams 364 which reduce friction during movement between positions. Though mechanical assistance may be provided, longitudinal brace 330 can be designed light enough for manual manipulation.

FIG. 20 provides an exploded view of the end of deck bed 362 and main beams 364. The thickness of main beams 364 is exaggerated here to aid in disclosure. As shown, extendable end 368 has been pulled out from under the deck bed. In reality, it would never come completely out in operation, but this view illustrates how it slides into place. The leading edge of the extendable end 368 is supported by a crossmember with guide wheels 373 at each end. These guide wheels 373 run along the in-ward facing lower flange of the main beam 364 to translate the extendable ends back and forth Inner stacking fitments 319 are positioned a fixed distance inboard of outer stacking fitments 306. While the longitudinal gap between fitments 319 and fitments 306 remain fixed, fitments 319 travel laterally within inner fitment retainer 371 fixed to the bottom of the extendable end 368. This is to allow the fitments 319 to travel past the main beams when the extendable ends are pulled in. (See FIG. 20B).

Notably, the portion of the extendable ends inboard of the inboard stacking fitments 319 remains below the deck bed 362 at all times. When the extended end 368 is in the "out" position (see FIG. 22), this portion 370 serves as a cantilever pressing up against the bottom of the deck bed 362 to keep the extendable ends from bending or bowing down. The flange of main beam 364 continues to extend under this portion on either side. Even with this, the localized load capacity of the extendable end portion 368 of the container may be further restricted than loading on the deck bed 362 under which the main beams 364 extend.

The extendable ends 368 have two positions—in and out. The "in" position places the outer stacking fitments 306 directly under the main posts 310, with end crossmember 380 being in line with the end of deck bed 362. When the extendable ends 368 are "in", the container is at the standard ISO 40' length used for overseas transport, and the inner stacking fitment 319 position has no significance (see FIG. 22A). In the "out" position, the outer stacking fitments 306 and end crossmember 380 are 53' feet from their counterparts on the far side of the container 300. The container is then at the standard length used on rail and over-the-road transport in North America. In this extended configuration, inner stacking fitments 319 are now aligned at the forty foot points, with a forty foot point crossmember 382 (not shown) running between them and extending underneath the deck bed 362. Accordingly, the container 300 can be hauled or stored as a 40' container or as a 53' container. The extendable ends 368 are necessarily slightly lower than the surface of the deck bed 362 (see FIG. 20), but ideally this depth is only a few inches and pallets or a custom shim could be used to fill this gap where a more level 53' floor is required.

Figure 23:
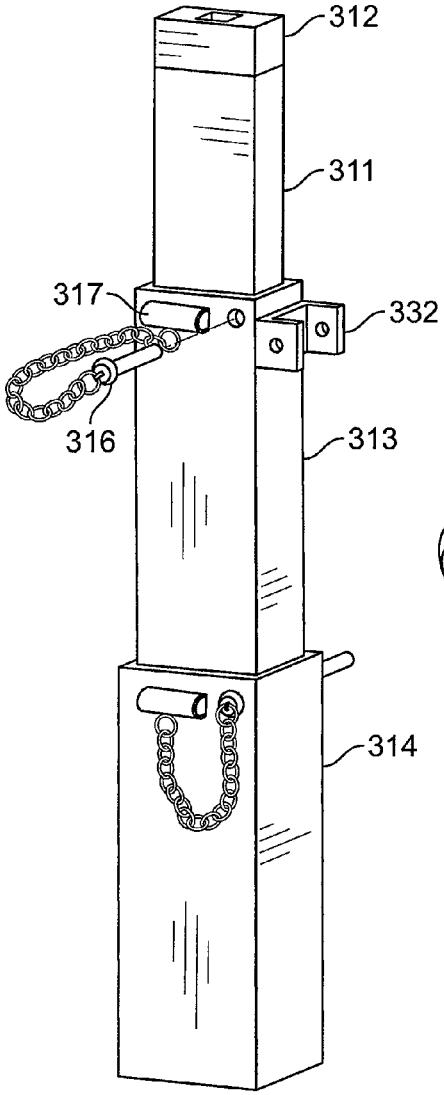
FIGS. 23 and 24 are isometric views of portions of a main post of the collapsible intermodal container of FIG. 18 showing certain operations involved in transition between storage to haul configurations.
Figure 24:
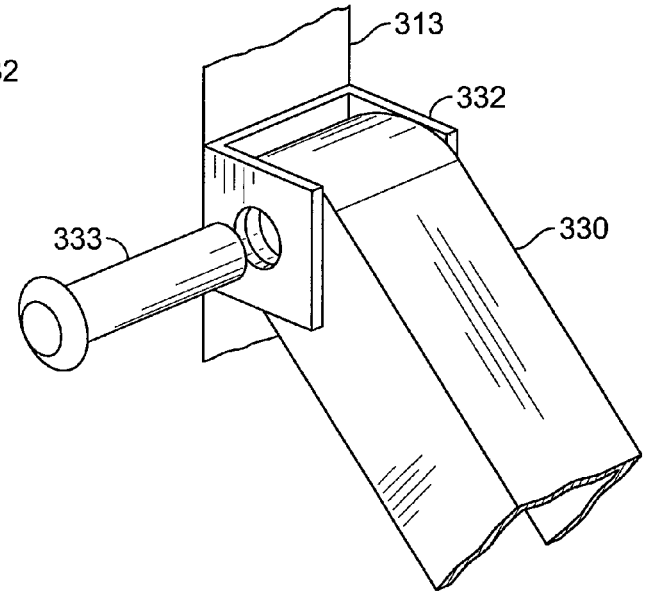

FIGS. 23 and 24 illustrate ways in which the container 300 is secured in its various configurations. Though hydraulic pressure may be used to maneuver between the configurations, mechanical connects are relied upon to hold them in place. As shown in FIG. 23, each section of the main post 310 has a section pin 316 and section pin retainer 317 mounted on its exterior surface. Notably, these pins pass through the respective sections above their internal hydraulic reservoirs. In the down position, the pins 316 are placed in the attached retainers 317. Separately, a brace pin 333 is placed through a brace bracket 332 and a corresponding hole at the end of the longitudinal brace 330 to hold it in place to the middle section of the main post 313. Though not shown, the extendable ends 368 would also have a redundant pinning mechanism to secure them in one of their two positions.

Figure 25A:
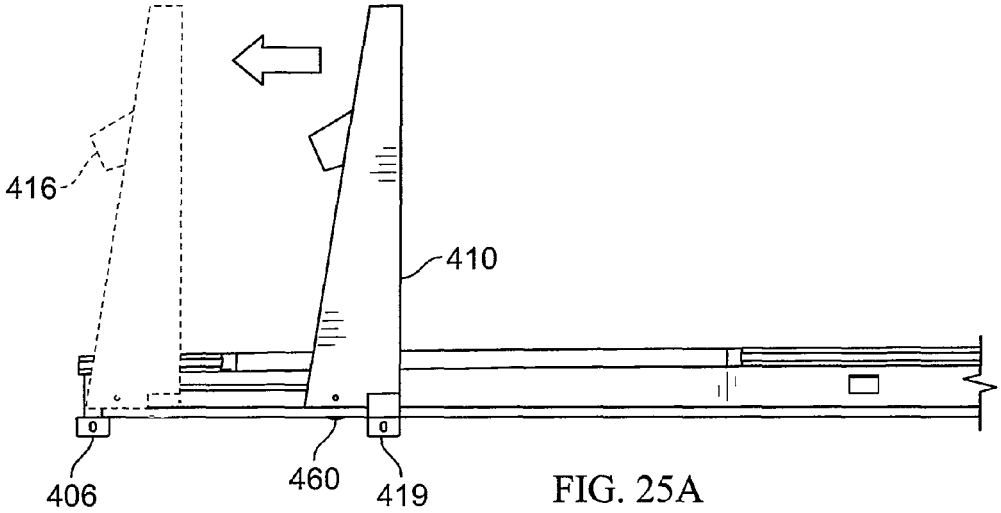
FIGS. 25A-25C are side views of portions of a fourth embodiment of a collapsible intermodal container transitioning from a haul configuration to an extended load configuration, and finally to a storage configuration.
Figure 25B:
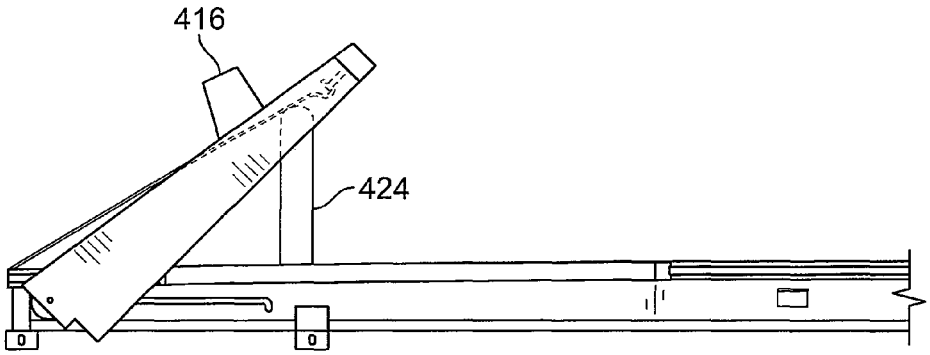
Figure 25C:
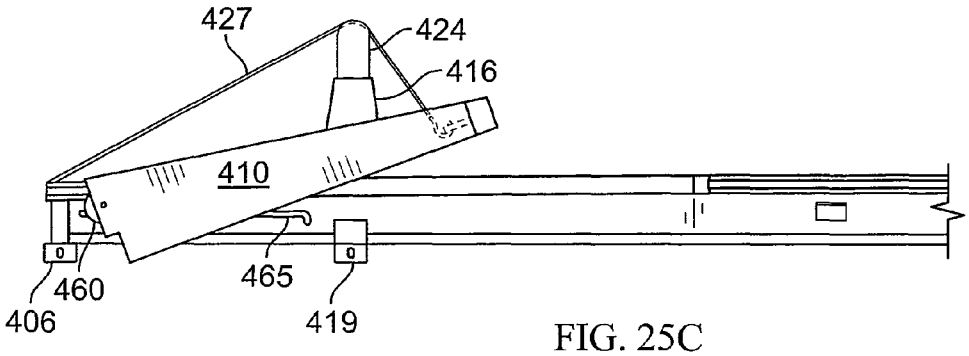

FIGS. 25A-25C illustrate a fourth embodiment of an intermodal container 400 that also has haul, load and storage positions. In this embodiment, main posts 410 extend from either side of the platform container at the forty-foot positions. They are joined at their tops by a connector beam 420 (see FIG. 26) and support lifting fitments 412 at their ends. Together, the main posts and connector beam form a rigid yoke assembly. However, there is no sub-deck connection between the posts, and no axle to drive them in a rotatable manner. Rather, to move from a haul position (FIG. 25A solid lines) to a load position (FIG. 25A hashed lines), the yoke assembly is pushed or pulled along a track guide 465 cut into the main beam 464 on either side of the platform 400. Thus, the main beam 410 moves from its haul position, where lifting fitments 412 are positioned over the top of stacking block receivers 419, to its load position where the main post is out over the corner fitment 406.

Figure 29:
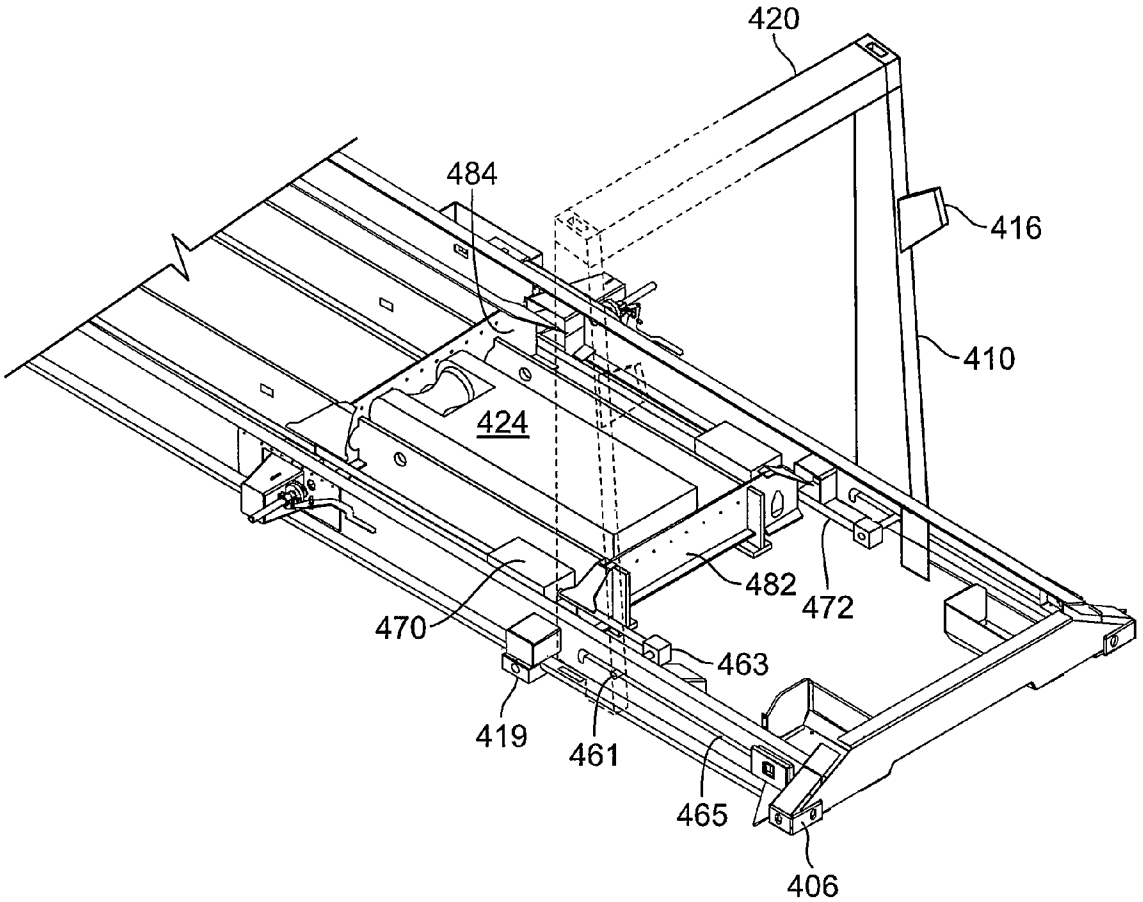
FIG. 29 is an isometric cutaway view of the collapsible intermodal container shown in FIGS. 25A-25C, where a portion of the deck has been removed to reveal underling components.

To move to a storage position, the main posts must first be placed in the load position. Then, as shown in FIG. 25B, the main posts (and the entire yoke assembly) is lowered down toward the surface of the deck bed 462 in a manner similar to that shown in FIGS. 8 and 8A-8C. Namely, a cable routing mechanism 424 pops up to help guide a cable 427 that runs from a spool (and winch) at the deck end to a hook attached to the center of the connector beam 420. As shown in FIG. 29, the cable routing mechanism 424 is oriented in the opposite direction than is cable mechanism 124 for FIG. 8. This is because the connector beam 420 will be passing closer to the end of the container since rotation occurs when the main posts are at the ends rather than near the forty foot points.

Figure 28:
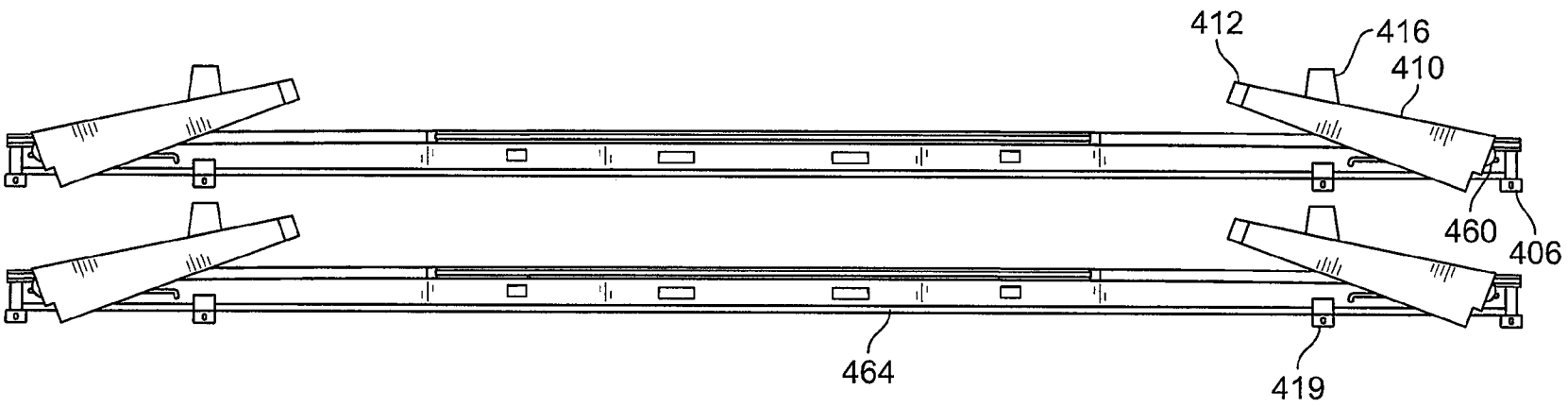

Once the connector beam reaches the deck bed surface, the cable slackens and may be recoiled. Alternatively, a torsion spring may be housed beneath the deck and positioned to engage the bottoms of the main posts 410 when in the load position. The torsion spring could then provide mechanical assistance to lower and raise the yoke assembly. Stacking blocks 416 mounted on the main posts 410 are positioned so as to be directly over the stacking block receivers 419 when the posts are in the storage position. This facilitates stacking multiple containers 400 together. See, e.g., FIG. 28.

Figure 27:
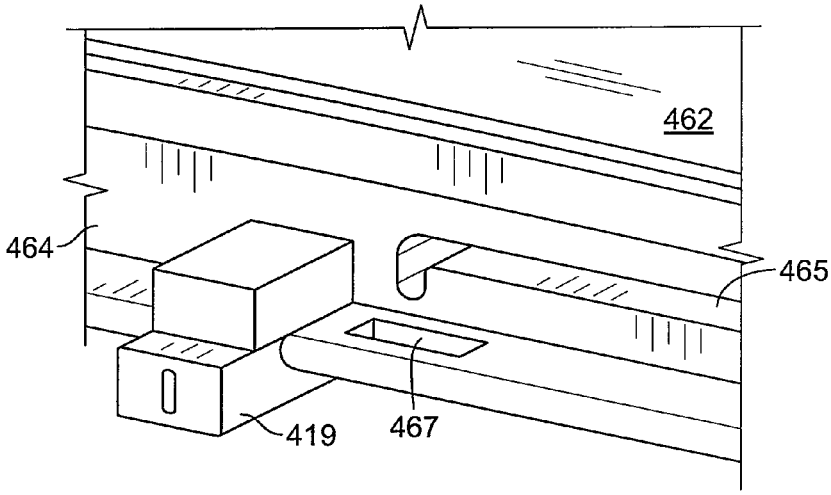
FIG. 27 is an isometric close-up view of a portion of the main beam of the collapsible intermodal container shown in FIGS. 25A-25C, showing where the main post rests.
Figure 30A:
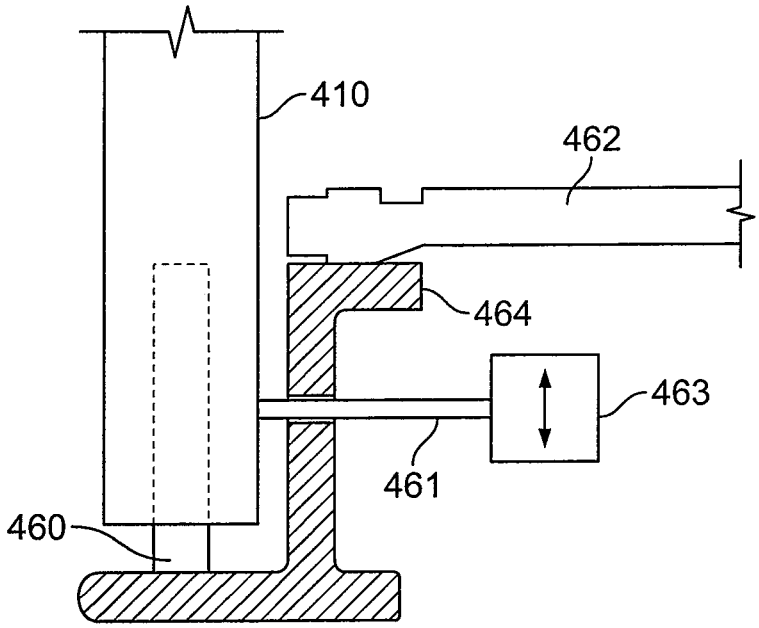
FIGS. 30A and 30B are partial section views from an end of the collapsible intermodal container shown in FIGS. 25A-25C, showing main post travel between haul and load position

To facilitate translation between haul and load positions, a traveler wheel 460 is set into the base of each main post 410. This traveler wheel 460 moves along the outside lower flange of main beam 464, as shown in FIG. 30A. In this embodiment, the main beam 464 is formed such that there is little or no upper flange extending outboard, because the main post 410 must pass along this space. While the main post is in translation and while it is in the load position at the ends of the container, the connector wheels 460 bear the weight of the yoke assembly. However, these wheels cannot bear the weight of the yoke during lift or carry operations (i.e., when the main posts are loaded with compression loads during haul operations, such as when another intermodal container is being supported on top of them). Therefore, wheels slots 467 are provided to unload the wheels at the haul positions. The slot 467 is shown in FIG. 27 in close-up view, and the wheel is shown in the slot, such that the weight of the main post is loaded on the main beam flange, in FIG. 30B.

Figure 26:
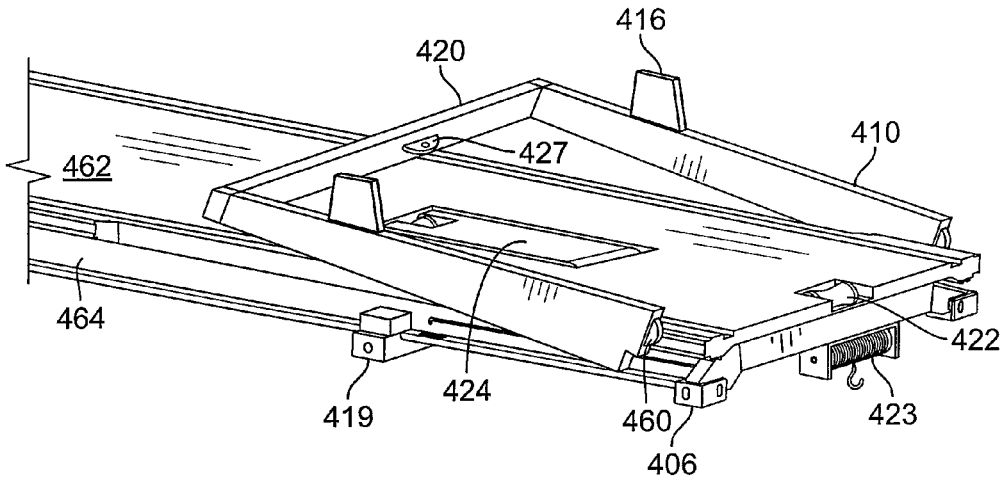
FIG. 26 is an isometric view of a corner of the collapsible intermodal container shown in FIGS. 25A-25C in the storage configuration.
Figure 30B:
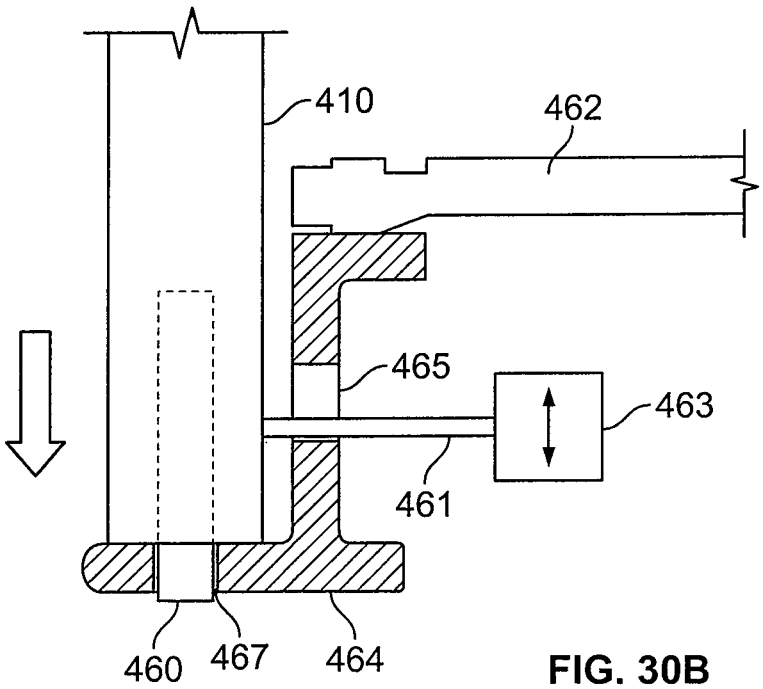

To assist in moving the yoke assembly, motor assemblies 470 are provided beneath the surface of the deck bed 462. (See FIG. 29). The motor assemblies are fixed to the main beam 464 or the forty foot point crossmember 482, and drive a ram 472 which pushes (or pulls) on a push block 463 connected to the main posts 410 via a through rod 461 that passes through the travel guide 465 cut in the main beam. (See, e.g., FIGS. 29 and 30A). As explained above, a wheel slot 467 is provided to unload the wheel. When the wheel falls into this slot, the yoke assembly may need to move up or down slightly. The travel guide 465 cut into the main beam 464 accommodates this, as shown in FIG. 29 and FIGS. 30A and 30B, which show sections of the main beam taken at the haul configuration position (30B) and the load configuration position (30A). Vertical movement could be minimized by fixing the wheel 460 on a floating axle fixed to a spring which would allow the wheel to release as it passes over the slot with little drop in main post height. As the main post 410 transitions from load to storage, an operator will need to disconnect the through rods 461 from the wheels 460, because the wheels will be lifted up off of the track of the lower flange during rotation, as shown in FIG. 26.

The present invention addresses shortcoming in prior art attempts to deliver a serviceable, efficient and durable flatbed suitable for intermodal transport operations. The disclosed designs and methods for operation provide a solution for logistics companies to transport full length loads on a lightweight platform that can be lifted and stacked when fully loaded or empty. When empty, the platform may be collapsed substantially flat so as to allow several platforms to be stacked and transported on a single chassis or stored in a limited space. Controlled hydraulic or electric power prevents damage to components and enables smooth, safe conversion between stowed, lift and extended load positions by a single human operator. Various safety pins and retention features are provided to ensure a robust design.

Accordingly, it should now be clear how the intermodal collapsible transport platform 100 can be used to facilitate intermodal load transport in a convenient, efficient manner. Any process descriptions or blocks in the figures, such as FIGS. 13-14, should be understood as representing a logical sequence of steps in a process, and alternate implementations are included within the scope of the embodiments of the present invention in which functions may be executed out of order from that shown or discussed, as would be understood by those having ordinary skill in the art.

It should be emphasized that the above-described exemplary embodiments of the present invention, and particularly any "preferred" embodiments, are possible examples of implementations, merely set forth for a clear understanding of the principles of the invention. Many other variations and modifications may be made to the above-described embodiments of the invention without substantially departing from the spirit and principles of the invention. All such modifications are intended to be included herein within the scope of this disclosure and the present invention and protected by the following claims.

What is claimed is:

1. A convertible cargo platform for transport by rail and over-the-road trailer having a first length extendable to a second length, the platform comprising:

a rectangular deck bed of the first length having two sides and two ends;

main beams of the first length extending beneath each side of the deck bed, each main beam having a lower flange; and an extendable end comprising:

a supplemental loading surface;

an end crossmember with outer stacking fitments on either side thereof; and inner stacking fitments;

wherein, when the cargo platform is at its first length, the extendable end is positioned substantially beneath the deck bed with the outer stacking fitments located at a first of the two ends of the deck bed, and, when the cargo platform is at its second length, the extendable end is extended outward from the first of the two ends of the deck bed such that the inner stacking fitments are located at the first end of the deck bed while the outer stacking fitments are positioned beyond the first end of the deck bed.

2. The convertible cargo platform of claim 1, wherein the first length is approximately forty feet such that the outer stacking fitments are positioned at intermodal ISO stacking positions.

3. The convertible cargo platform of claim 1, wherein the second length is approximately fifty-three feet, such that the outer stacking fitments are positioned for placement on a standard length over-the-road trailer.

4. The convertible cargo platform of claim 1, wherein the extendable end further comprises guide wheels, each guide wheel traveling along the lower flange of one of the main beams to transfer the extendable end from beneath the deck bed to extended outward from the first end of the deck bed.

5. The convertible cargo platform of claim 1, wherein the inner stacking fitments are retractable into a housing such that they are positioned in between the main beams when the convertible cargo platform is at its first length.

6. The convertible cargo platform of claim 5, wherein the inner stacking fitments are positioned at intermodal ISO stacking positions when the convertible cargo platform is at its second length.

7. The convertible cargo platform of claim 1, further comprising extendable main posts at each of four corners of the rectangular deck bed, each main post comprising at least an upper section that extends from and retracts into a lower section.

8. The convertible cargo platform of claim 7, wherein the main posts extend and retract under hydraulic power.

9. The convertible cargo platform of claim 7, wherein each main post comprises an ISO lifting fitment positioned at a top of its upper section.

10. An intermodal container convertible between a first length and a second length, the container comprising:

a loading platform having two sides and two ends;

a main beam running under each of the two sides of the loading platform, each main beam providing an inward facing flange; and an extendable end positionable between the main beams and supported by the inward facing flange, the extendable end comprising:

a supplemental loading surface;

outer stacking fitments having fixed positions relative to the supplemental loading surface; and inner stacking fitments having adjustable positions relative to the supplemental loading surface.

11. The intermodal container of claim 10, wherein, when the intermodal container is at its first length, the extendable end is positioned substantially beneath the loading platform.

12. The intermodal container of claim 11, wherein the outer stacking fitments are positioned at intermodal ISO stacking positions.

13. The intermodal container of claim 11, wherein the inner stacking fitments are retracted into a housing such that they are inward of the main beams.

14. The intermodal container of claim 10, wherein, when the intermodal container is at its second length, the supplemental loading surface is extended from one of the two ends of the loading platform.

15. The intermodal container of claim 14, wherein the outer stacking fitments are positioned for placement on a standard length over-the-road trailer.

16. The intermodal container of claim 15, wherein the inner stacking fitments are extended outward of the main beams and positioned at intermodal ISO stacking positions.

17. The intermodal container of claim 10, further comprising extendable main posts at each of four corners of the loading platform, each main post comprising at least an upper section that extends from and retracts into a lower section.

18. The intermodal container of claim 17, wherein the main posts extend and retract under hydraulic power.

19. The intermodal container of claim 17, wherein each main post comprises an ISO lifting fitment positioned at a top of its upper section.

20. The intermodal container of claim 17, further comprising a longitudinal brace connectable to each main post.

* * * * *